US007178678B2

(12) United States Patent
Mansfield et al.

(10) Patent No.: US 7,178,678 B2
(45) Date of Patent: Feb. 20, 2007

(54) MERCHANDISE DISPLAY HOOK

(75) Inventors: Eric H. Mansfield, North Canton, OH (US); Richard E. Corney, Akron, OH (US)

(73) Assignee: Alpha Security Products, Inc., Charlotte, NC (US)

( * ) Notice: Subject to any disclaimer, the term of this patent is extended or adjusted under 35 U.S.C. 154(b) by 122 days.

(21) Appl. No.: 10/800,346

(22) Filed: Mar. 12, 2004
(Under 37 CFR 1.47)

(65) Prior Publication Data

US 2005/0029205 A1 Feb. 10, 2005

Related U.S. Application Data

(60) Provisional application No. 60/493,211, filed on Aug. 6, 2003.

(51) Int. Cl.
*A47F 5/08* (2006.01)

(52) U.S. Cl. ..... 211/7; 211/59.1; 248/221.11

(58) Field of Classification Search ..... 211/59.1, 211/7, 54.1, 57.1; 248/221.11; 70/413, 57.1
See application file for complete search history.

(56) References Cited

U.S. PATENT DOCUMENTS

| | | | | |
|---|---|---|---|---|
| 1,695,517 | A | 12/1928 | Waldbauer | |
| 2,441,407 | A | 5/1948 | Glavies | |
| 2,868,390 | A | 1/1959 | McCrone | |
| 3,048,311 | A | 8/1962 | Neuenfeldt | |
| 3,472,385 | A | 10/1969 | Shapiro et al. | |
| 3,567,034 | A | 3/1971 | Mozelsio | |
| 3,581,905 | A | 6/1971 | Shapiro | |
| 3,610,423 | A | 10/1971 | Parillo | |
| 3,622,011 | A | 11/1971 | Snow | |
| 3,659,721 | A | 5/1972 | Parillo | |
| 3,735,875 | A | 5/1973 | Parillo | |
| 3,827,569 | A | 8/1974 | Canning | |
| 3,934,727 | A | 1/1976 | Brefka | |
| 3,993,195 | A | 11/1976 | Caligiuri | |
| 4,008,835 | A | 2/1977 | Budzik | |
| 4,109,795 | A | 8/1978 | Konigsford et al. | |
| 4,254,879 | A | 3/1981 | Maule | |
| 4,289,242 | A | 9/1981 | Kenyon | |
| 4,289,721 | A | 9/1981 | Ishise | |
| 4,300,690 | A | 11/1981 | Thomas | |
| 4,324,352 | A | 4/1982 | Goldfarb et al. | |
| 4,362,249 | A * | 12/1982 | Thalenfeld | 211/59.1 |
| 4,363,430 | A | 12/1982 | Radlin | |
| 4,462,497 | A | 7/1984 | Maule | |

(Continued)

FOREIGN PATENT DOCUMENTS

| | | |
|---|---|---|
| DE | 198 43 036 | 3/2000 |

(Continued)

*Primary Examiner*—Peter M. Cuomo
*Assistant Examiner*—Jared W. Newton
(74) *Attorney, Agent, or Firm*—Sand & Sebolt

(57) ABSTRACT

A lockable display hook adapted to display items of merchandise in a retail environment includes a lock that directly engages the rod assembly of the display hook. The lock is configured to securely lock to the rod assembly without the need for teeth or notches to be formed in the rod assembly. One embodiment of the display hook provides an end assembly that prevents sweeping while allowing quick loading of merchandise.

41 Claims, 20 Drawing Sheets

U.S. PATENT DOCUMENTS 4,474,300 A * 10/1984 Entis ..... 211/57.1
4,553,294 A 11/1985 Larsen
4,718,626 A * 1/1988 Thalenfeld et al. .... 248/220.22
5,009,334 A 4/1991 Bodkins
5,011,054 A 4/1991 Mauffette
5,012,997 A 5/1991 Hutchison
5,018,627 A 5/1991 Moore
5,027,622 A 7/1991 Hatch et al.
5,042,669 A 8/1991 Goldring
5,082,215 A 1/1992 Hutchison
5,160,048 A 11/1992 Leyden et al.
5,251,757 A 10/1993 Relyea et al.
5,251,767 A 10/1993 Wiederer
5,259,220 A 11/1993 Fredrickson
5,275,027 A 1/1994 Eklof et al.
5,348,167 A * 9/1994 Jensen ..... 211/57.1
5,407,170 A 4/1995 Slivon et al.
5,423,436 A 6/1995 Morrow
5,441,161 A 8/1995 Merl
5,485,930 A 1/1996 Rushing
5,542,633 A 8/1996 Nagel
5,597,150 A 1/1997 Stein et al.
5,624,040 A 4/1997 Hono
5,676,258 A 10/1997 Leyden et al.
5,689,978 A 11/1997 Eklof et al.
5,702,008 A 12/1997 Thalenfeld et al.
5,711,432 A 1/1998 Stein et al.
5,765,801 A 6/1998 Geiselman
5,823,358 A 10/1998 Leyden et al.
5,823,407 A 10/1998 Mayer et al.
6,003,685 A 12/1999 Malin
6,131,748 A 10/2000 Kawasaki et al.
6,223,915 B1 5/2001 Waner
6,279,256 B1 8/2001 Norolof et al.
6,349,909 B1 2/2002 Zarrow et al.
6,446,819 B1 9/2002 Mattesky
6,474,121 B2 * 11/2002 Sakai et al. ..... 70/276
6,474,478 B1 11/2002 Huehner et al.
6,622,979 B2 9/2003 Valiulis
6,659,291 B2 12/2003 Huehner et al.
2001/0013567 A1 8/2001 Valiulis
2003/0029816 A1 2/2003 Huehner et al.
2004/0026344 A1 * 2/2004 Sedon et al. ..... 211/7

FOREIGN PATENT DOCUMENTS

EP 1199012 A1 4/2002
FR 2606985 5/1988
FR 2795294 A1 12/2000

* cited by examiner

MERCHANDISE DISPLAY HOOK

CROSS REFERENCE TO RELATED APPLICATIONS

This application claims priority from U.S. provisional application Ser. No. 60/493,211 filed Aug. 6, 2003; the disclosures of which are incorporated herein by reference.

BACKGROUND OF THE INVENTION

1. Technical Field

The present invention relates generally to merchandise display hooks that support items of merchandise for review by potential customers. These display hooks are designed to be cantilevered from a support structure such as a display board or a display rack. More particularly, the present invention relates to such display hooks that either prevent the rapid removal of items of merchandise from the display hooks or prevent removal of items of merchandise while the display hook is locked. The invention also relates to a display hook that may be locked to the support structure to prevent the removal of the display hook from the support structure while also preventing the removal of merchandise from the hook or preventing the rapid removal of the merchandise from the hook.

2. Background Information

Items of merchandise are commonly displayed for sale on long protruding rods supported from a support structure in the nature of a peg board, a slat board, or a wire rack. These protruding rods are commonly referred to in the art as display hooks, peg board hooks, or slat board hooks. Similar rods may also protrude from a wire display rack for the same purpose. Usually, the items of merchandise are relatively small but expensive, such as batteries, small tools, cosmetic products, or health care products. Such merchandise is an easy target for shoplifters because they can rapidly remove all the items from a display hook and leave the store without being detected. Alternately, the shoplifter can remove the entire display hook with the merchandise and leave the store. Therefore, it is desired in the art to provide display hooks that prevent both the removal of the display hooks from the support structure, the rapid removal of items of merchandise from the display hooks, or a combination of both features.

BRIEF SUMMARY OF THE INVENTION

In one embodiment, the invention provides a lockable display hook wherein a lock member interacts directly with the rod of the display hook without requiring notches or grooves to be formed in the rod of the display hook. The lock member prevents the display hook from being removed from its support structure until a key is used to move the lock member to an unlocked position.

In one embodiment, the invention provides a magnetically actuatable locking mechanism that interacts directly with the rod of the display hook.

A different embodiment of the invention provides an end assembly for the display hook that limits product sweeping wherein the entire contents of the display hook may not be swept rapidly from the display hook by a shoplifter.

In one embodiment, the invention provides an end assembly that limits product sweeping while allowing quick product loading.

In another embodiment, the invention provides an end assembly that accepts product identification and/or price tags.

BRIEF DESCRIPTION OF THE SEVERAL VIEWS OF THE DRAWINGS

FIG. 27 is a section view taken along line 27—27 of FIG. 26.

FIG. 29 is a section view taken along line 29—29 of FIG. 28.

FIG. 30 is an enlarged view of the encircled portion of FIG. 29.

FIG. 31 is a section view taken along line 31—31 of FIG. 29.

Similar numbers refer to similar parts throughout the specification.

DETAILED DESCRIPTION OF THE INVENTION

Figure 1:
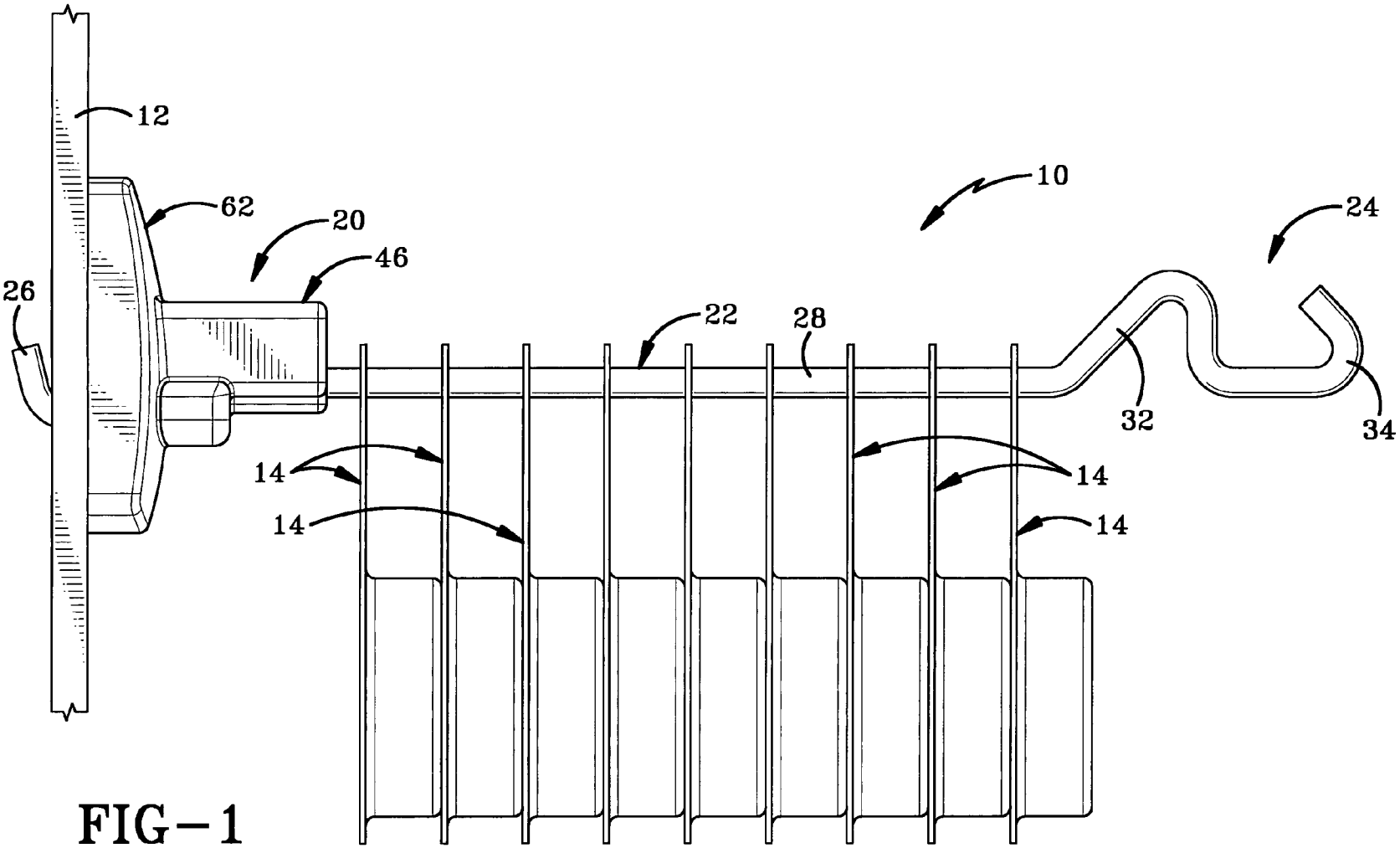
FIG. 1 is a side elevation view of a first embodiment of the merchandise display hook of the present invention.
Figure 2:
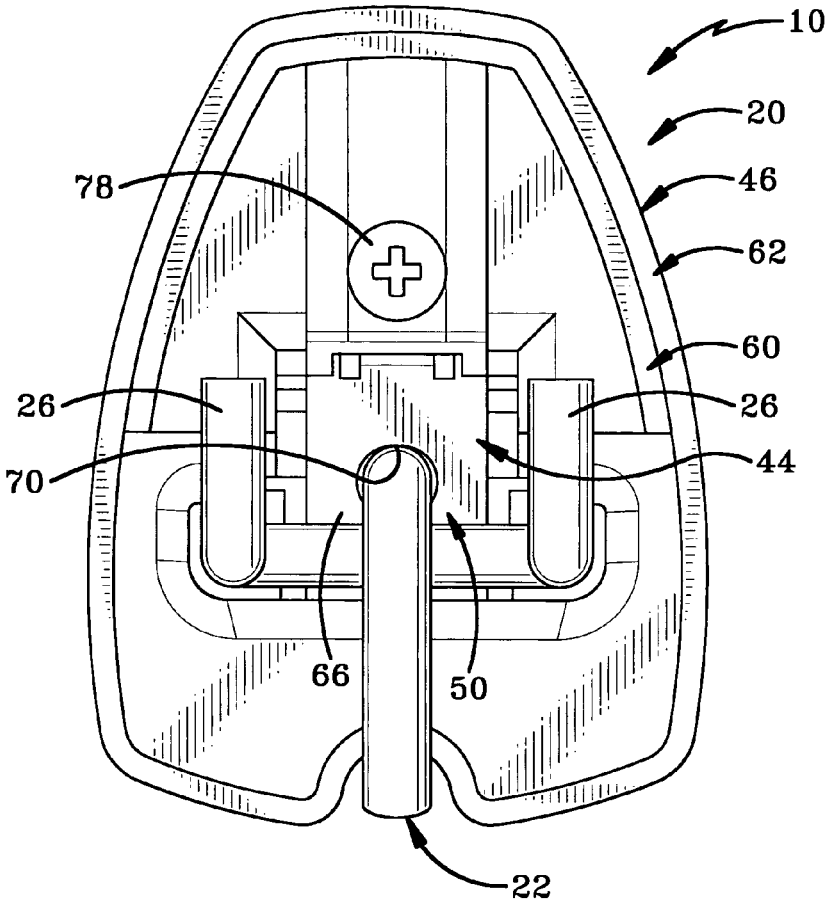
FIG. 2 is a rear elevation view of the base assembly.
Figure 3:
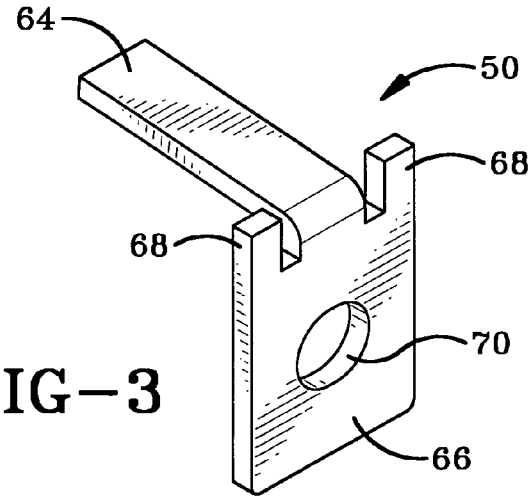
FIG. 3 is a perspective view of the first lock member.
Figure 4:
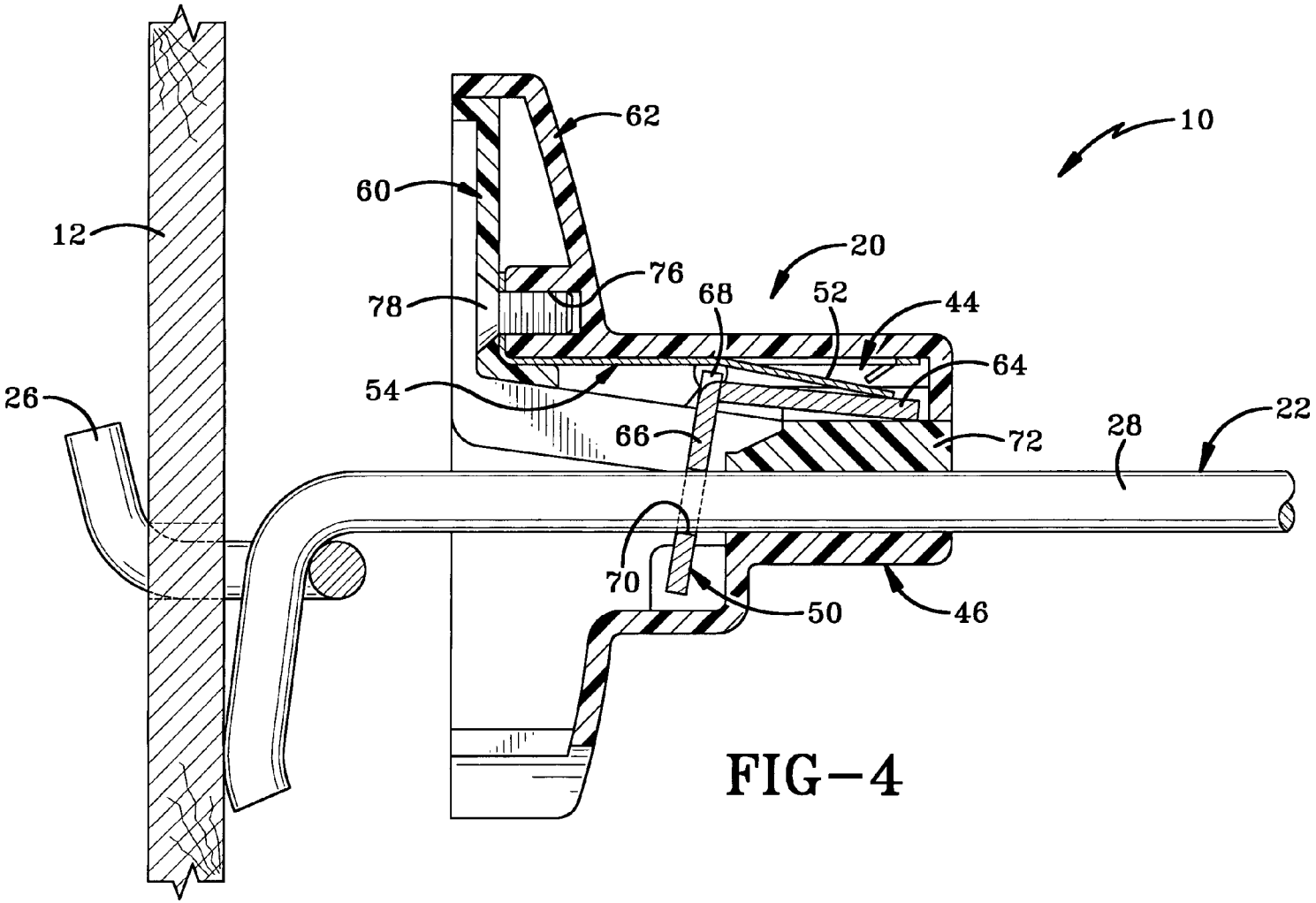
FIG. 4 is a side sectional view showing the base assembly in its unlocked position with the lock in its locked position.
Figure 5:
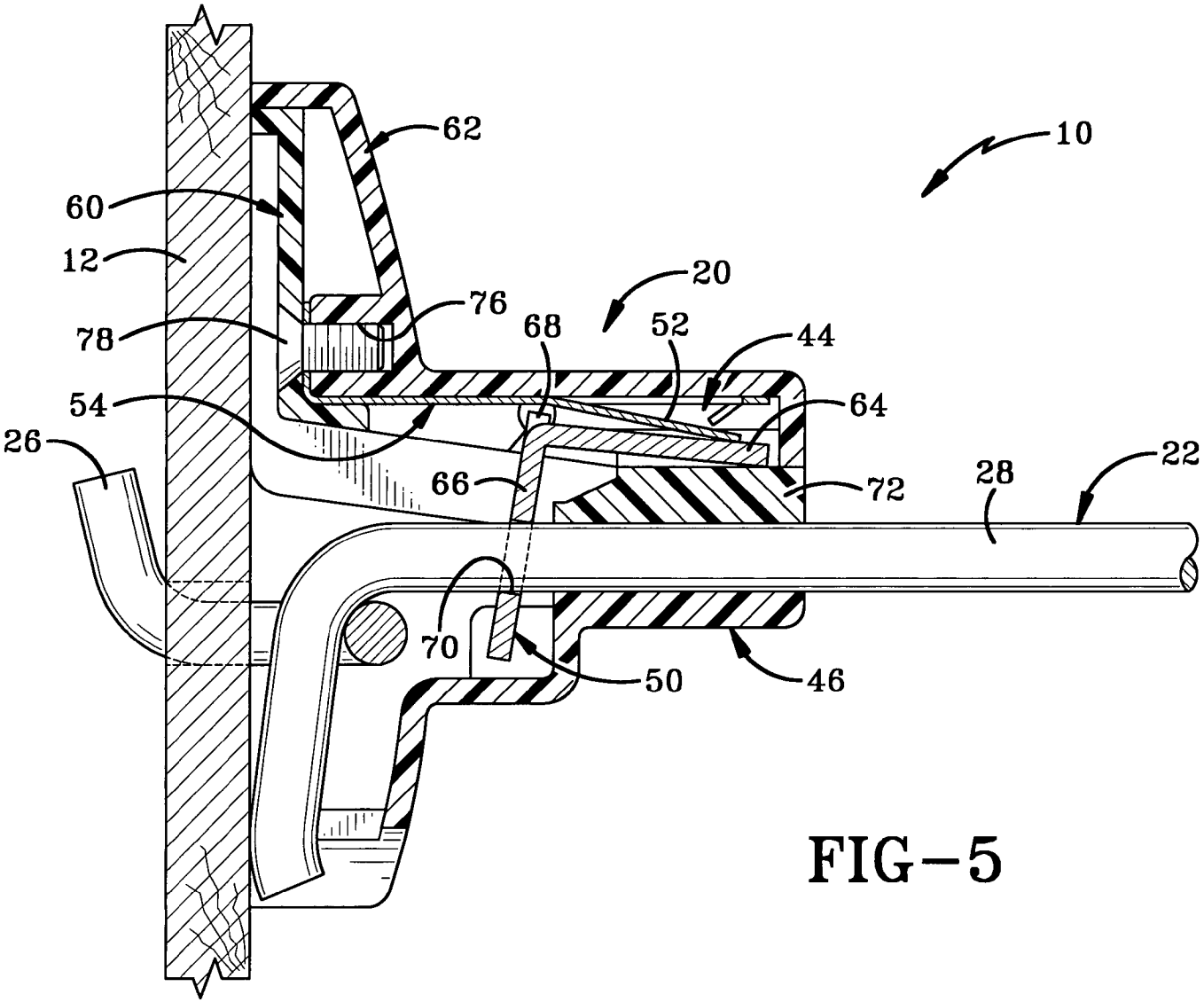
FIG. 5 is a view similar to FIG. 4 showing the base assembly in its locked position and the lock in its locked position.
Figure 7:
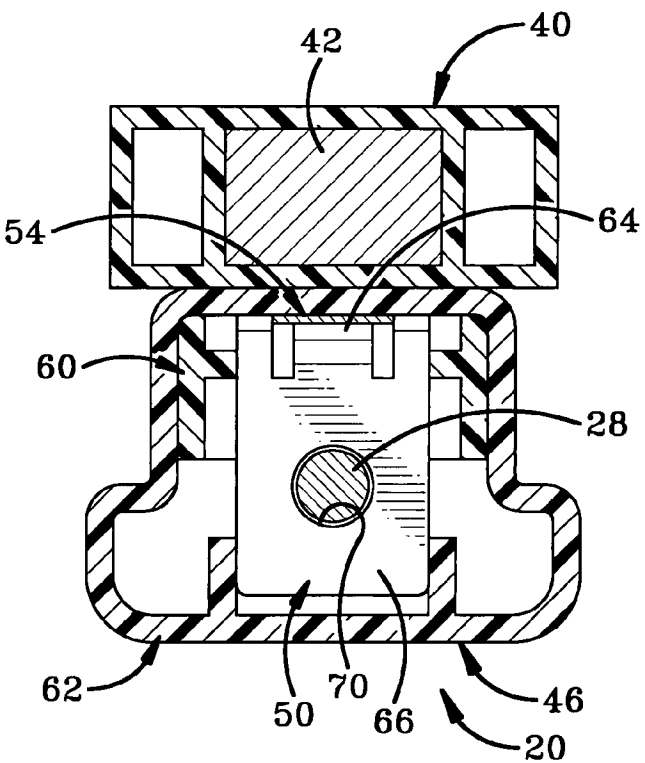
FIG. 7 is a section view taken along line 7—7 of FIG. 6.
Figure 6:
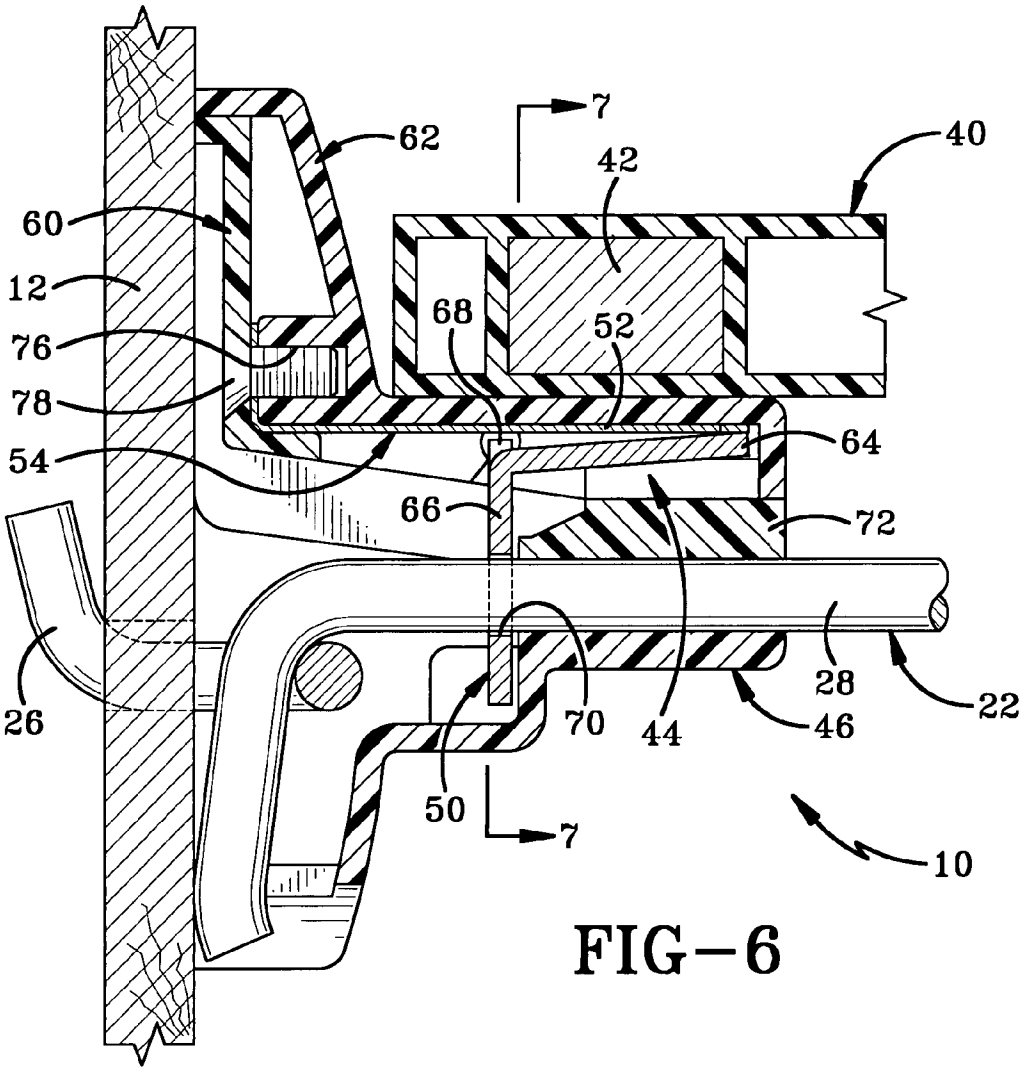
FIG. 6 is a view similar to FIG. 5 showing the lock in its unlocked position.
Figure 8:
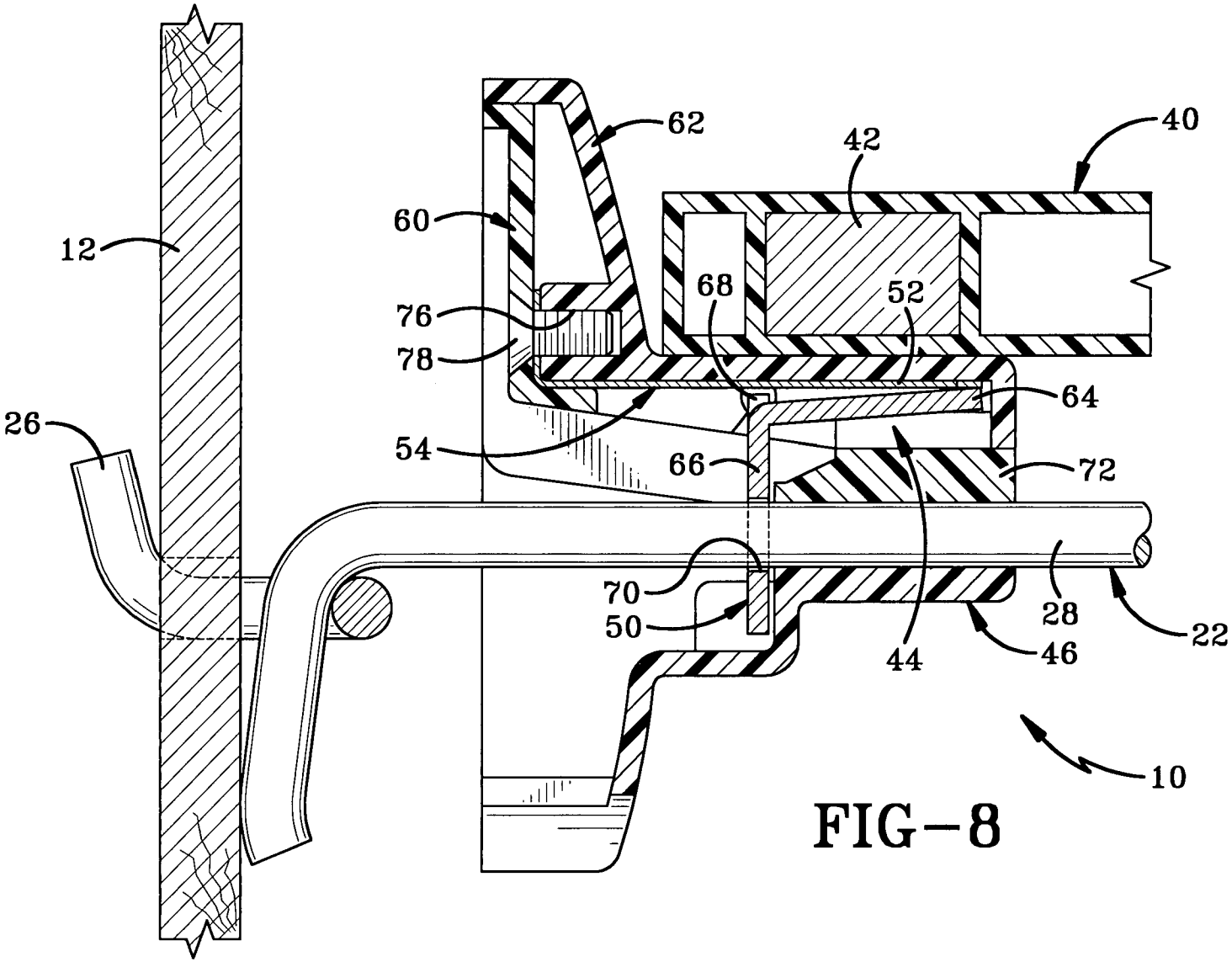
FIG. 8 is a view similar to FIG. 6 showing the base assembly moved to the unlocked position with the lock in the unlocked position.

One embodiment of the merchandise display hook of the present invention is indicated generally by the numeral 10 in the accompanying drawings. Another embodiment of the display hook of the invention is indicated generally by the numeral 100. Display hooks 10 and 100 are used with a support structure 12 to support items 14 of merchandise for display in a retail environment. Support structure 12 may be any of a variety of support structures used with display hooks 10 and 100 such as peg boards or slat boards, racks, shelves, and the like. Display hooks 10 and 100 are configured to be locked to support structure 12 so that a shoplifter may not simply remove the entire display hook 10 or 100 along with all of the merchandise carried by hook 10 or 100. Display hook 10 or 100 may also be configured to prevent sweeping which is a term of art used to describe a shoplifter's action of rapidly removing all of the merchandise displayed on a display hook with a quick sweeping action.

Figure 9:
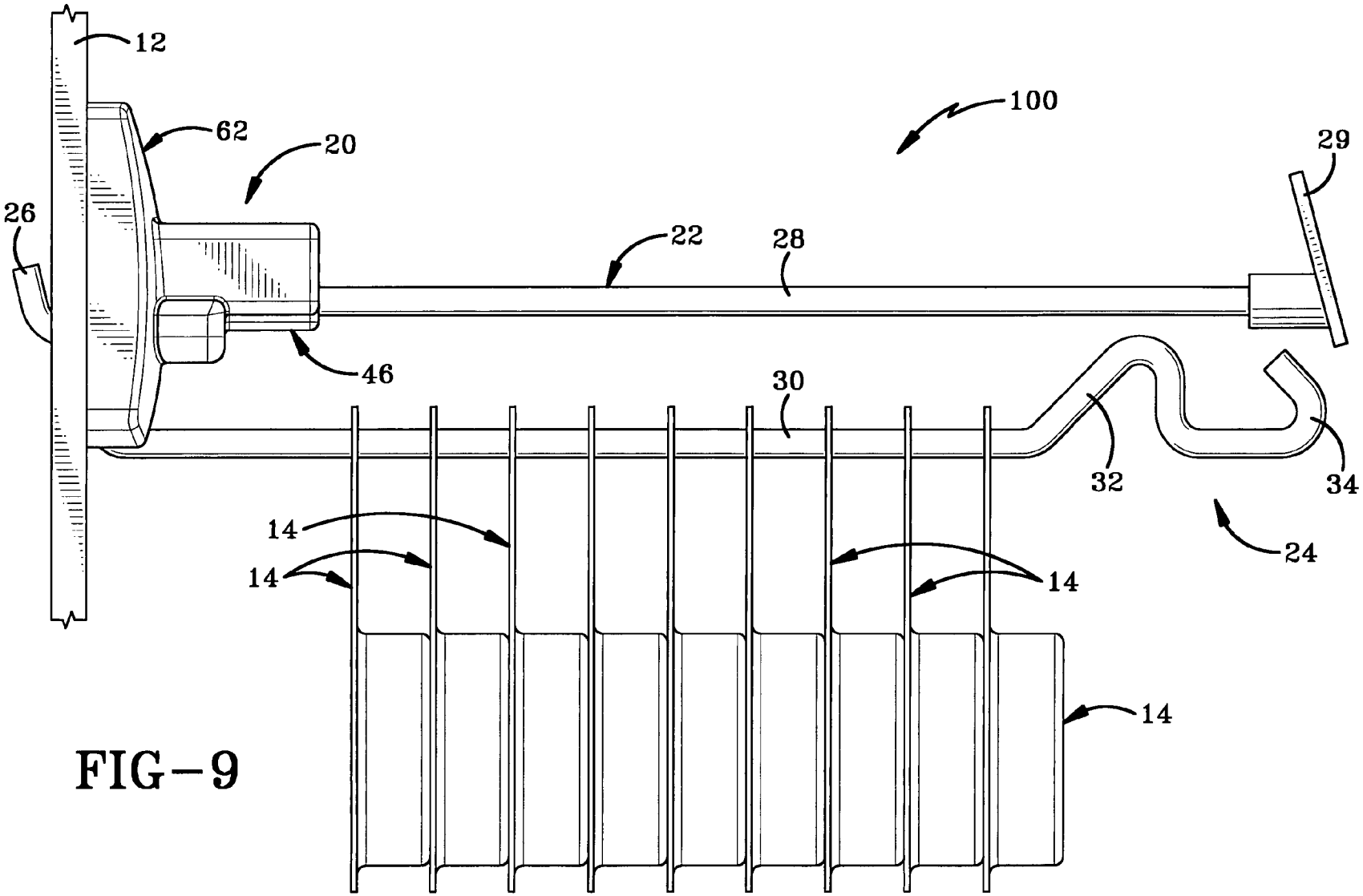
FIG. 9 is a side elevation view similar to FIG. 1 of a second embodiment of the merchandise display hook of the present invention.
Figure 10:
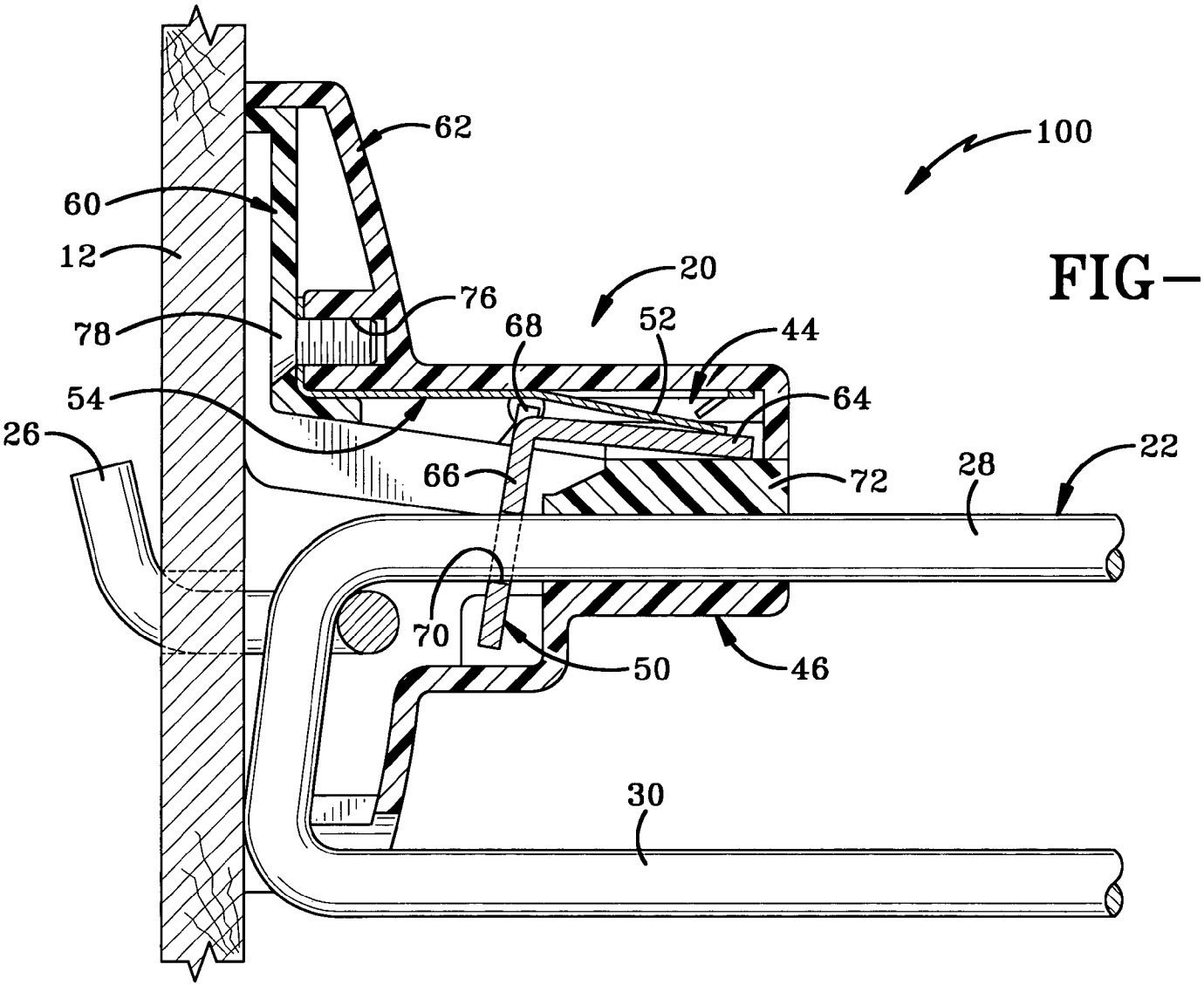
FIG. 10 is a section view of the base assembly of FIG. 9.
Figure 11:
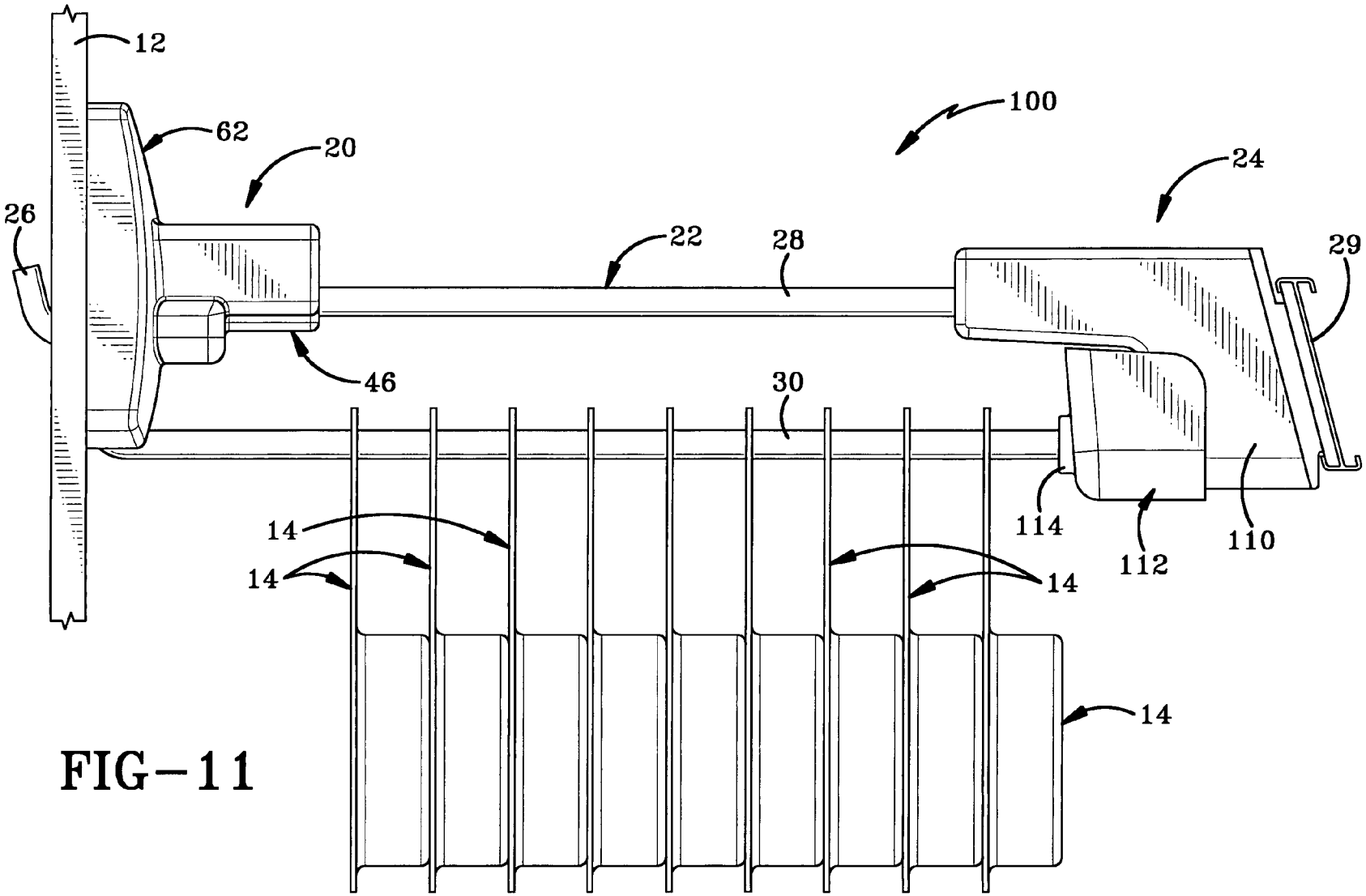
FIG. 11 is a side elevation view of a third embodiment of the merchandise display hook of the present invention.
Figure 12:
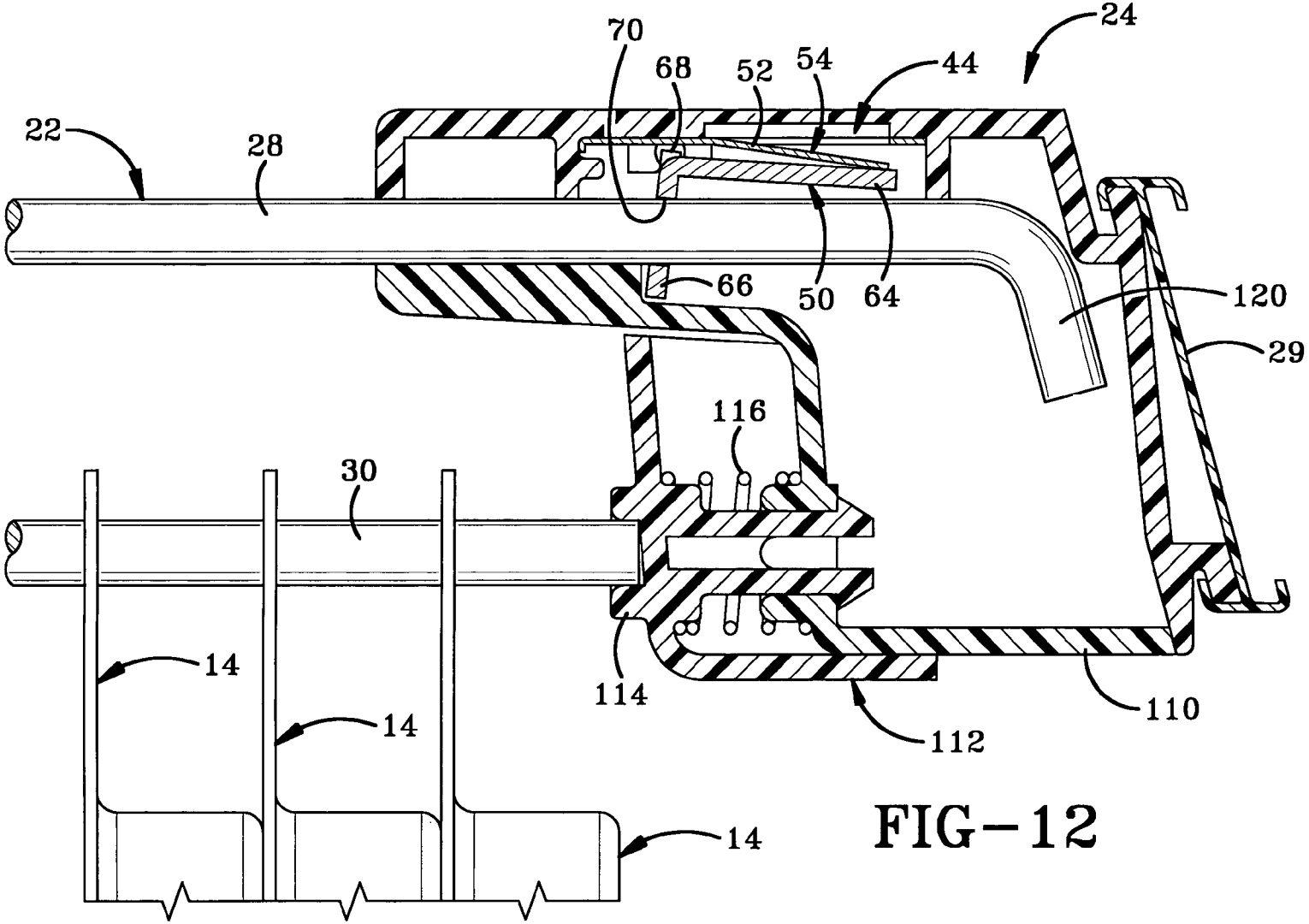
FIG. 12 is a sectional side view of the end assembly shown in FIG. 11.

Display hook 10 generally includes a base assembly 20 that locks hook 10 to support structure 12, a rod assembly 22 that supports items 14, and optionally, an end assembly 24 configured to limit merchandise sweeping. Rod assembly 22 includes an inner end and an outer end with the inner end being disposed adjacent support structure 12 when hook 10 is installed. The outer end of rod assembly 22 is where items 14 are removed from hook 10. In two of the exemplary embodiments (FIGS. 1 and 9), end assembly 24 is in the form of curved rod sections that slow the removal of items 14 from rod assembly 22. In this embodiment, end assembly 24 includes a curve or bend 32 that prevents sweeping by forcing the person removing item 14 to carefully manipulate item 14 around curve 32. End assembly 24 may also include an upwardly extending hook 34 that forces each item 14 to be turned more than 90 degrees from its display position in order to remove item 14. In another embodiment (FIG. 11), end assembly 24 is in the form of a body that resiliently engages the end of rod assembly 22. The FIG. 11 embodiment of end assembly 24 may be moved to a loading and unloading position when unlocked with a key.

In the embodiments of the invention depicted in the drawings and used to provide examples of the invention, rod assembly 22 also functions to connect hook 10 to support structure 12 with a pair of hooks 26. In other embodiments of the invention, hooks 26 may be separated from rod assembly 22. Hooks 26 may be provided in any of a variety of configurations as required by support structure 12.

Rod assembly 22 may be provided in a single rod configuration or a double rod configuration. When provided in a double rod configuration, rod assembly 22 includes an upper rod 28 and a lower rod 30 that each extend outwardly from support structure 12. Upper rod 28 cooperates with the lock of hook 10 or 100 to lock hook 10 or 100 to support structure 12. Upper rod 28 may be used to support end assembly 24 (FIG. 11) or may be used to support product information such as the identification of items 14 or the price of items 14 (element 29 in FIG. 9). Upper rod 28 may also be used to support items 14 as shown in FIG. 1. When provided, lower rod 30 carries items 14 and has a length adapted to allow rod 30 to hold a plurality of items 14. Rods 28 and 30 are typically fabricated from a metal material but may also be fabricated from a variety of other rigid materials such as any variety of suitable plastics.

Base assembly 20 selectively secures display hook 10 to display support structure 12 in a manner that prevents display hook 10 from being removed from support structure 12 without the use of a specific key 40. As used in this application, the term "locking" is different than a simple "latched" connection. A "latched" connection may be unlatched without the use of a special key while a "locked" connection requires a special key in order to limit the unlocking capability to those who posses a key. In the exemplary embodiment of the invention, key 40 includes a first magnet 42 or a plurality of magnets 42. In another embodiment, key 40 may mechanically interact with the lock mechanism.

Base assembly 20 also includes a lock 44 that secures base assembly 20 directly to rod assembly 22. Lock 44 is pivotally carried by the body 46 of base assembly 20 in a manner that allows lock 44 to move between locked and unlocked positions. The unlocked position of lock 44 allows base assembly 20 to be slid back and forth along rod assembly 22 with the locked position of lock 44 holding the position of base assembly 20 with respect to rod assembly 22.

Lock 44 includes a first lock member 50 and a second lock member 52. Second lock member 52 is movable between locked and unlocked positions by using key 40 which may use magnetic force. The locked position of second lock member 52 holds the position of first lock member 50 while the unlocked position of second lock member 52 allows first lock member 50 to pivot with respect to body 46. Second lock member 52 may be in the form of a biased lock finger that extends from a lock frame 54 that supports second lock member 52 from body 46. The biased finger may be a thin, metallic finger that can be pivoted to an unlocked position with magnetic force. The lock finger may also be pivoted by mechanically pulling upwardly on the finger. Lock frame 54 may be pinched between an inner body member 60 and an outer body member 62 of body 46. Hook 10 may be configured to function without second lock member 52 when a holding force is not necessary to hold first lock member 50 in the locked position.

First lock member 50 includes first 64 and second 66 lock member legs that connect to each other at an angle that is greater than 45° and less than 135°. First lock member 50 is carried by rod assembly 22 and is movable between locked and unlocked positions. Pivot arms 68 extend from either side of first lock member 50 adjacent the location where lock member legs 64 and 66 join together. Body 46 engages arms 68 to force lock member 50 into the locked position when body 46 is pulled in a direction from the inner end of rod 28 toward the outer end of rod 28 without first unlocking lock 44. In one embodiment of the invention, pivot arms 68 extend into openings defined by body 46 and support first lock member 50 in a pivoting condition wherein first lock member 50 may pivot between locked and unlocked positions.

Second lock member leg 66 defines an opening 70 that is slightly larger than the exterior diameter of upper rod 28. Opening 70 allows second lock member leg 66 and thus base assembly 20 to slide along upper rod 28 when lock 44 is in the unlocked position. Opening 70 is sized to frictionally engage upper rod 28 when lock 44 is in the locked position to prevent base assembly 20 from moving in a direction from the inner end of rod 28 toward the outer end of rod 28. Leg 66 and opening 70 may be configured to allow base assembly 20 to move back towards the inner end of rod 28 without use of key 40.

Second lock member leg 66 is thin compared to the diameter of upper rod 28 (the thickness of leg 66 is less than half of the diameter) with opening 70 being slightly larger than the diameter of upper rod 28 so that locking teeth and notches are not required to be formed in upper rod 28. The frictional and wedging engagement of second lock member leg 66 with upper rod 28 securely locks base assembly 20 in place without the need for such lock teeth or notches. Opening 70 may be generally oval-shaped or include a pair of semi-circular end portions connected by a straight portion. Each of the semi-circular end portions has a diameter slightly greater than the outer diameter of rod 28.

In operation, first lock member 50 is held in the locked position by second lock member 52. In order to unlock display hook 10, the user moves key 40 into the proper position causing second lock member 52 to pivot upwardly and out of engagement with first lock member 50. When key 40 is magnetic, the magnetic force of key 40 may also pull first lock member leg 64 upwardly causing second lock member leg 66 to pivot with respect to upper rod 28 such that opening 70 becomes aligned with rod 28 to allow base assembly 20 to slide with respect to upper rod 28.

As noted above, body 46 includes inner body member 60 and outer body member 62. In the exemplary embodiment of the invention, inner body member 60 is fabricated from a metal while outer body member 62 is fabricated from a plastic. Body members 60 and 62 cooperate to hold lock 44 in position as well as securely holding rod assembly 22 in position. As such, outer body member 62 includes a barrel 72 that frictionally or snugly engages upper rod 28. First lock member leg 64 is disposed above barrel 72 with second lock member leg 66 disposed behind barrel 72. The outer surface of inner body member 60 snugly engages the inner surface of outer body member 62 so that a tight fit is formed between the two members. Outer body member 62 defines an opening 76 adapted to receive a screw 78 that holds body members 60 and 62 together to trap lock 44 in place. Inner body member 60 provides strength and rigidity to base assembly 20 and prevents the destruction of base assembly 20 if a shoplifter were to grab the end of rod assembly 22 and twist, pull upwardly, sideways, or downwardly in an attempt to break base assembly 20.

Figure 13:
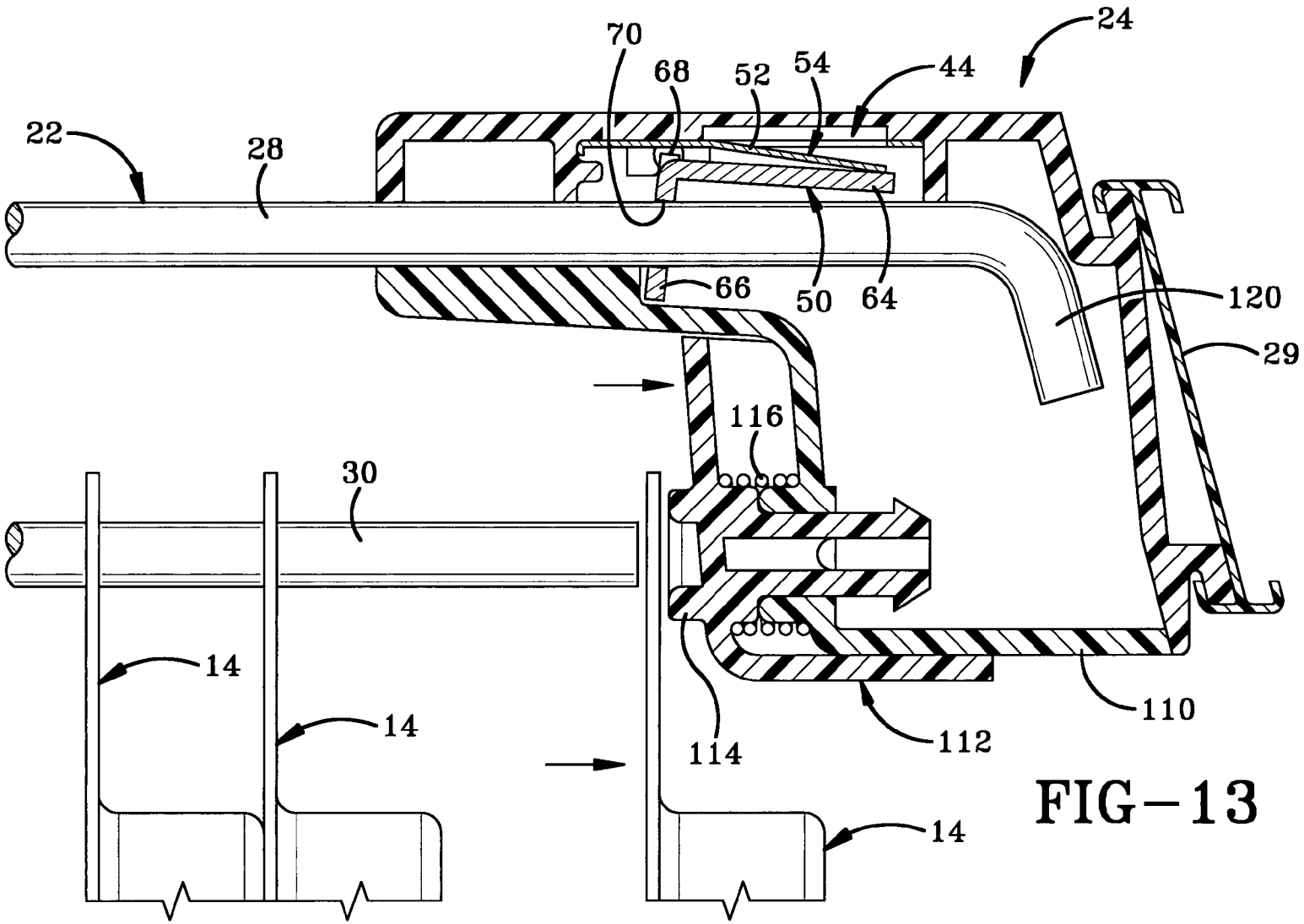
FIG. 13 is a view similar to FIG. 12 showing the end assembly moved to a loading position.
Figure 14:
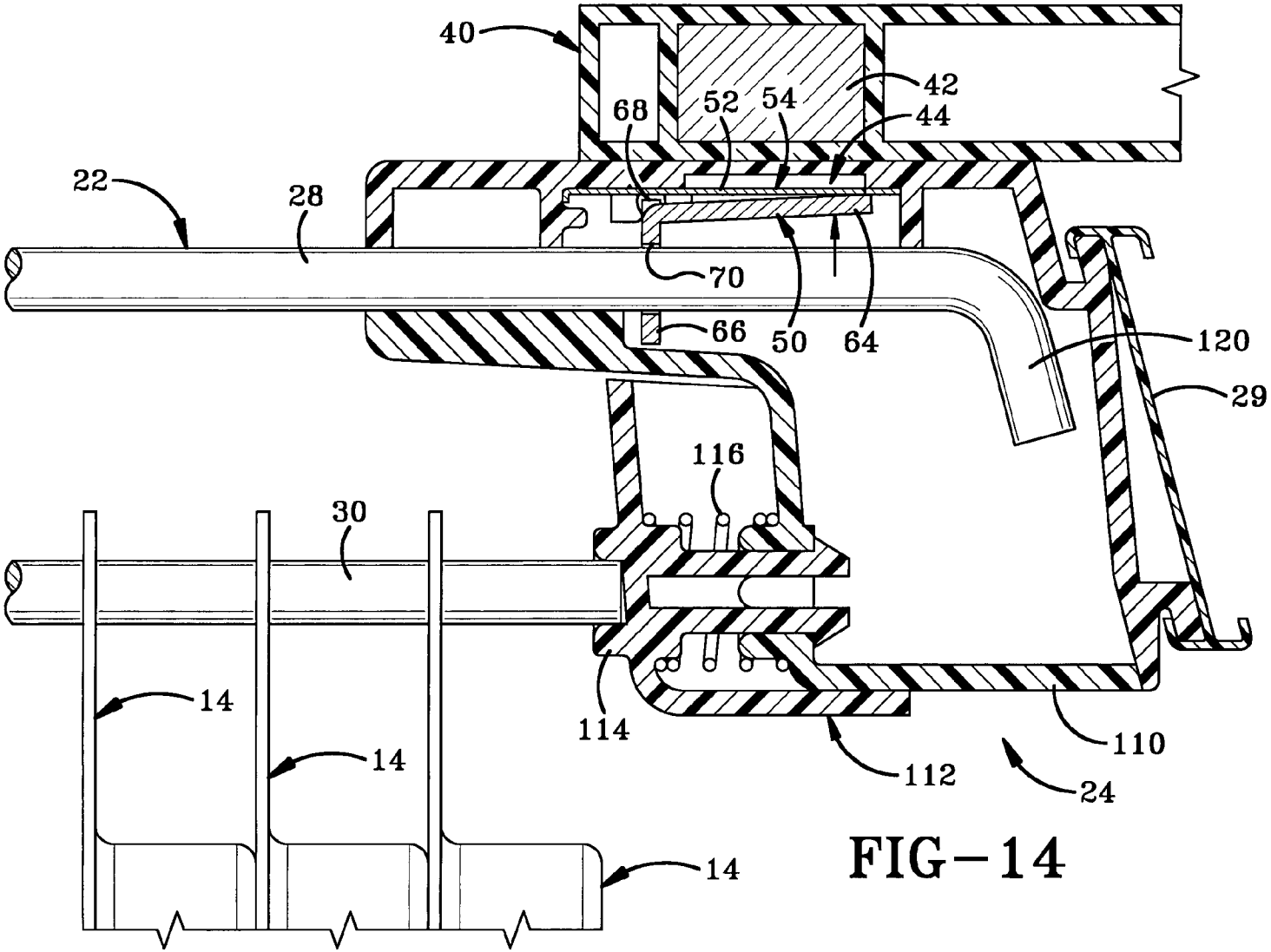
FIG. 14 is a section view of the end assembly in the anti-sweeping position with the lock unlocked.
Figure 15:
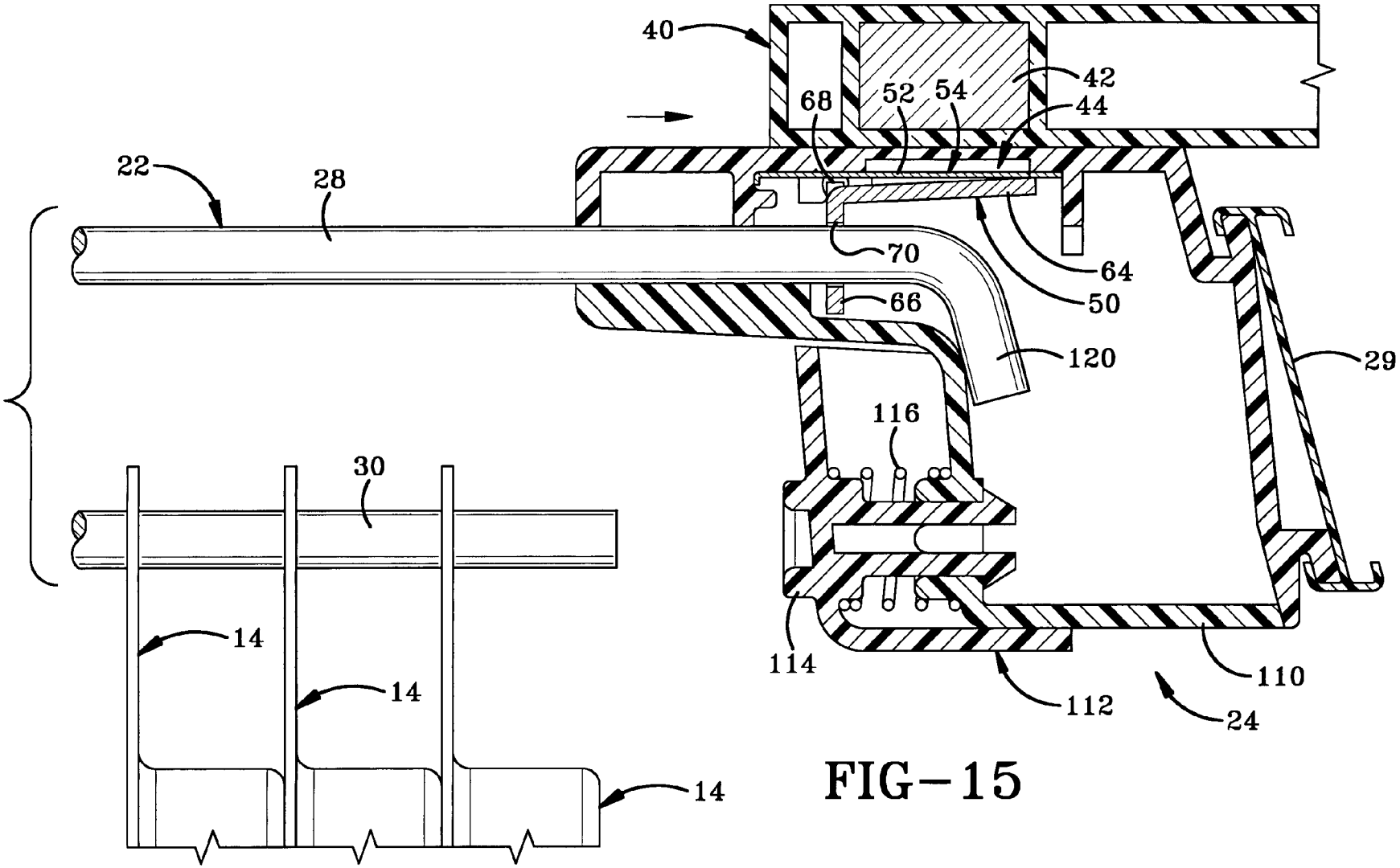
FIG. 15 is a view similar to FIG. 14 with the lock unlocked and the end assembly moved to the loading position.
Figure 16:
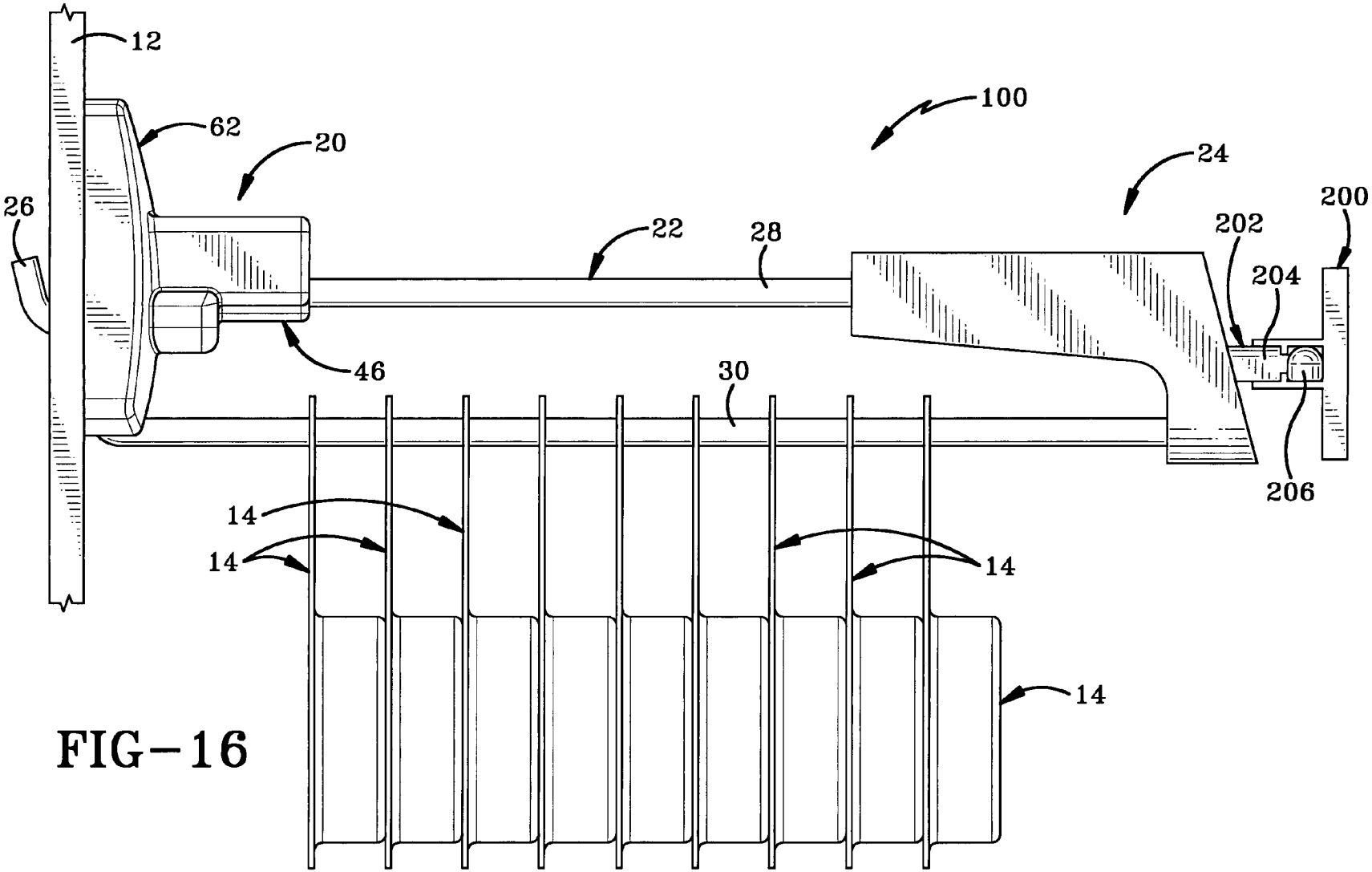
FIG. 16 is a side elevation view of a merchandise display hook having an alternative version of the end assembly wherein a product identification and/or price tag may be attached to the end assembly.
Figure 17:
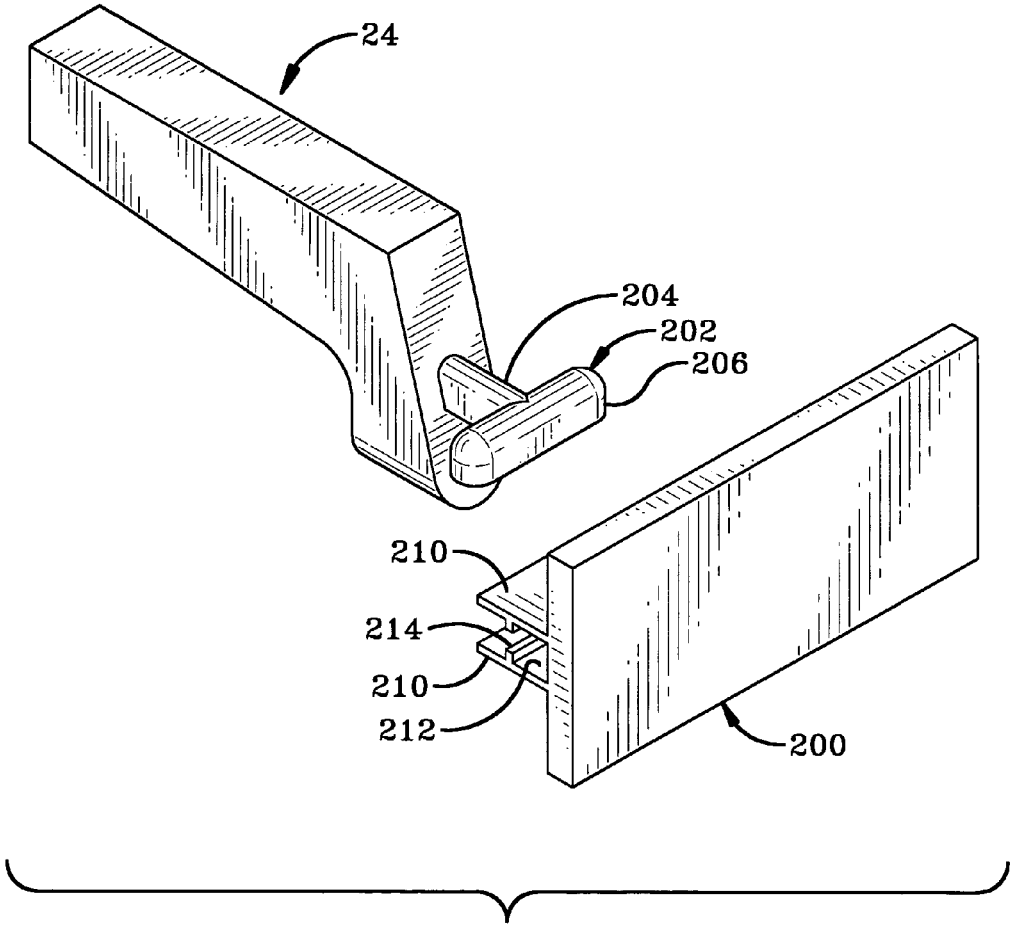
FIG. 17 is an exploded perspective view of the end assembly and tag.
Figure 18:
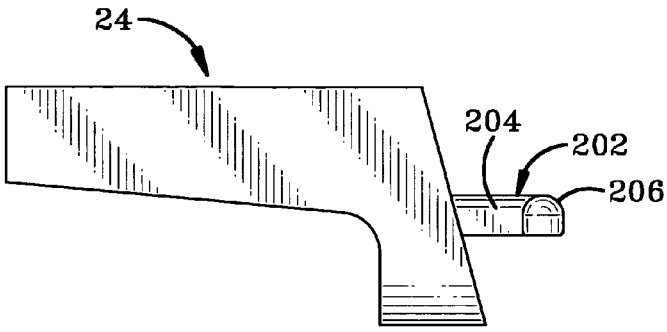
FIG. 18 is a left side elevation view of the end assembly.
Figure 19:
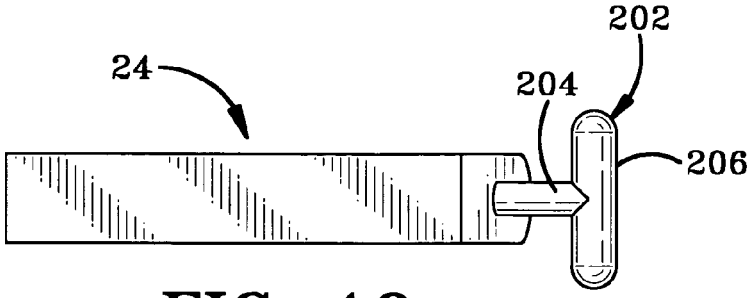
FIG. 19 is a top plan view of the end assembly.
Figure 20:
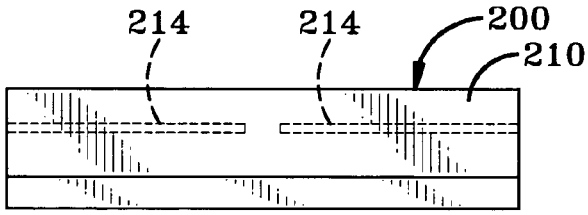
FIG. 20 is a top plan view of the tag.
Figure 21:
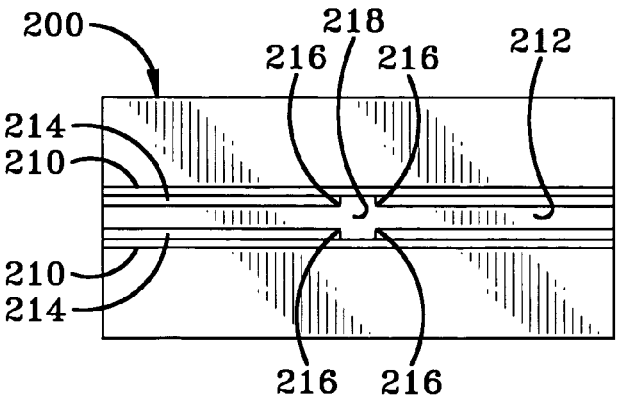
FIG. 21 is a rear elevation view of the tag.
Figure 22:
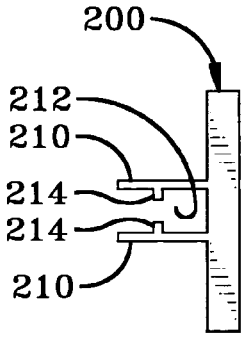
FIG. 22 is a side elevation view of the tag.
Figure 23:
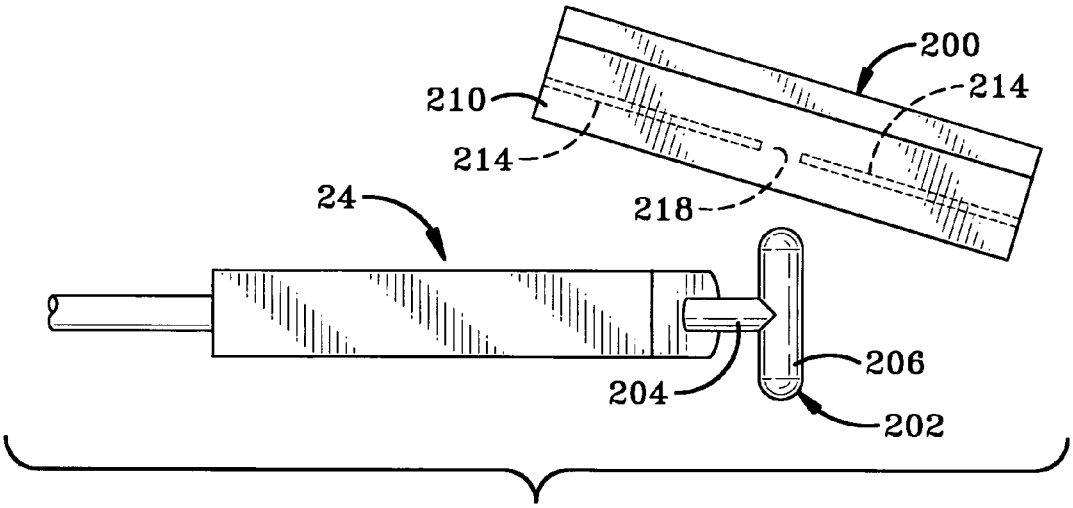
FIGS. 23–31 show the steps of connecting the tag with the end assembly wherein the tag is pivoted onto the cross bar.
Figure 24:
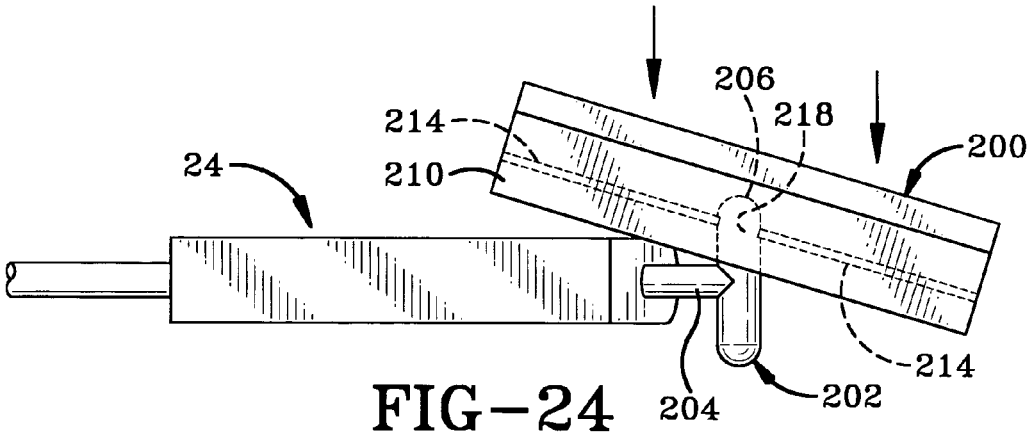
Figure 25:
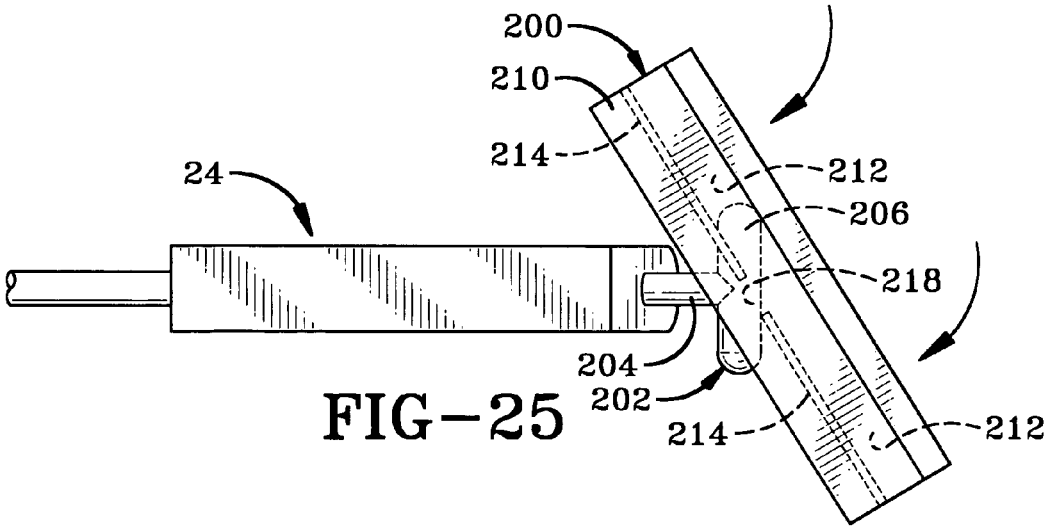
Figure 26:
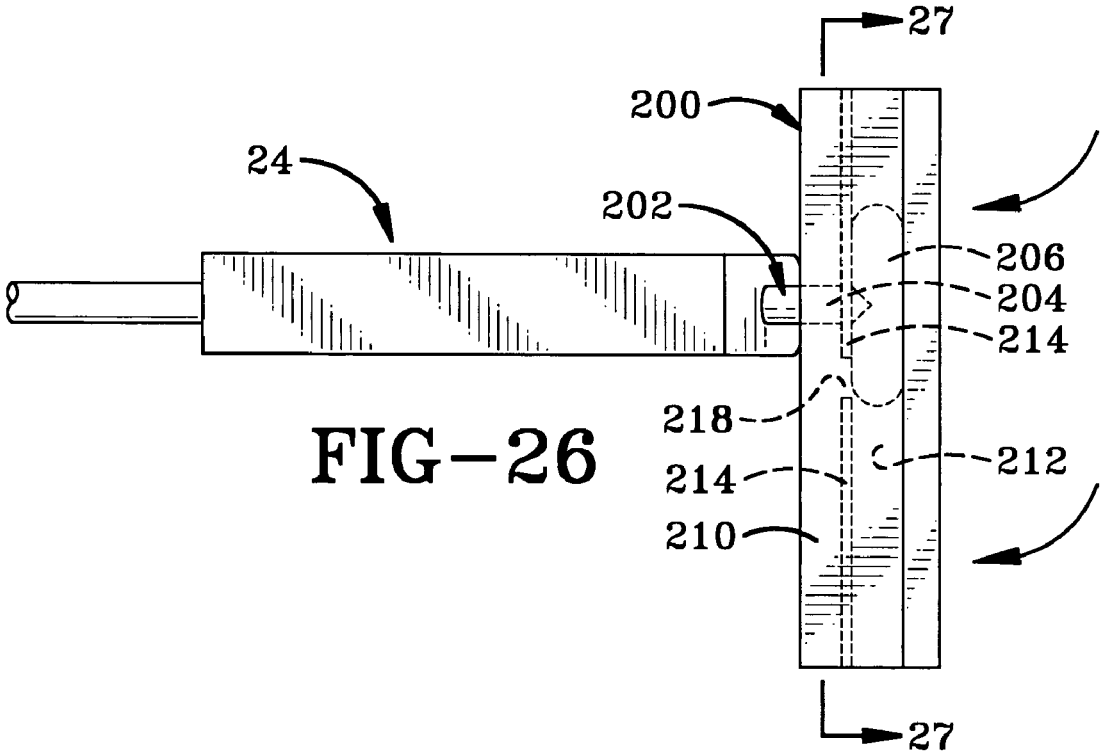
Figure 28:
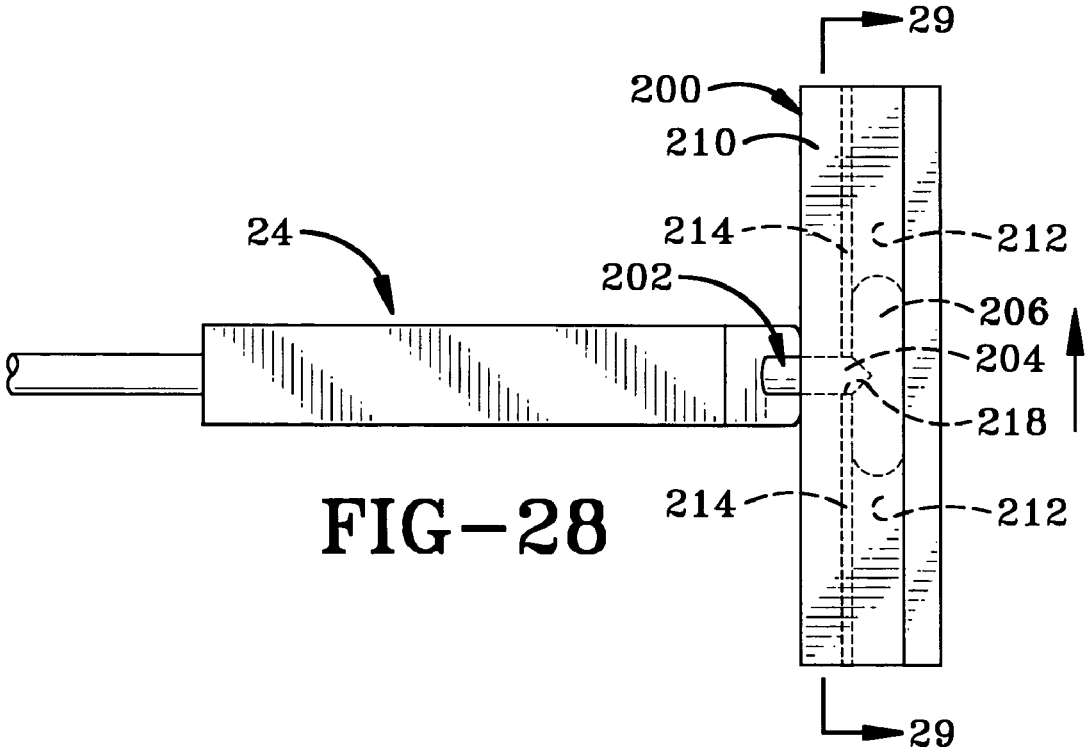
Figure 27:
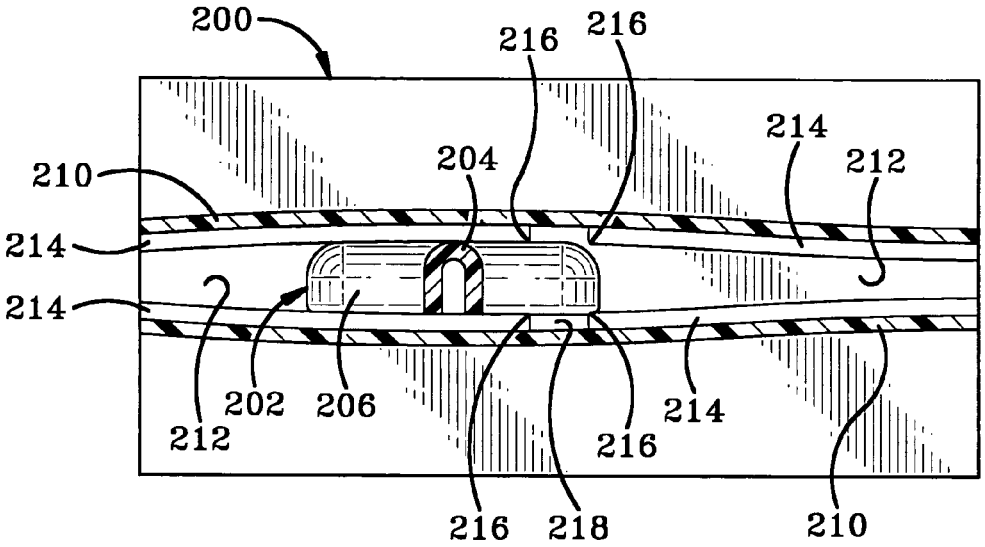
Figure 29:
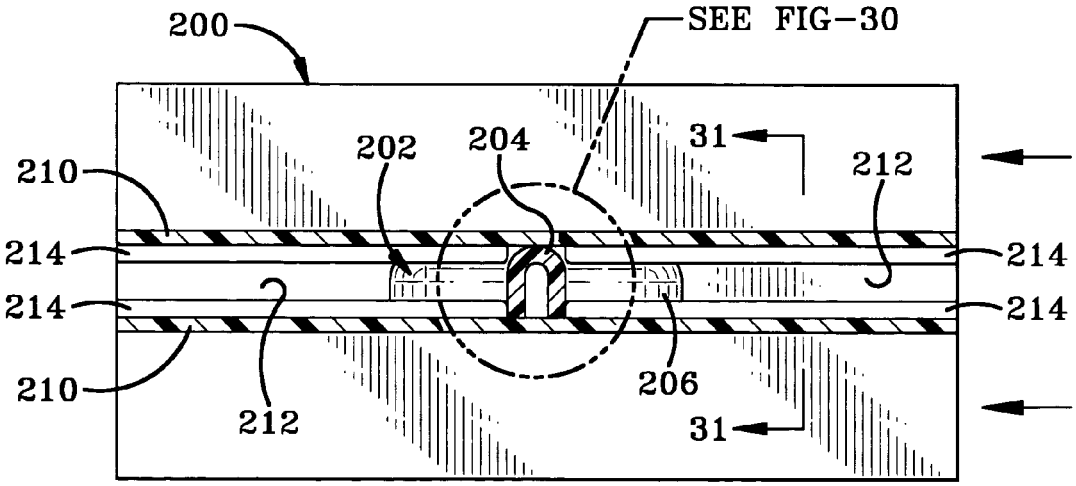
Figure 30:
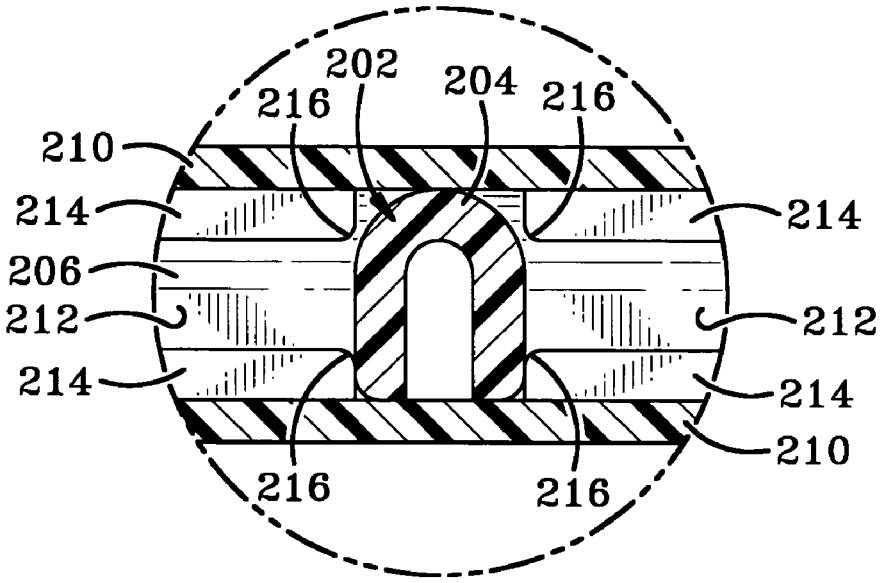
Figure 31:
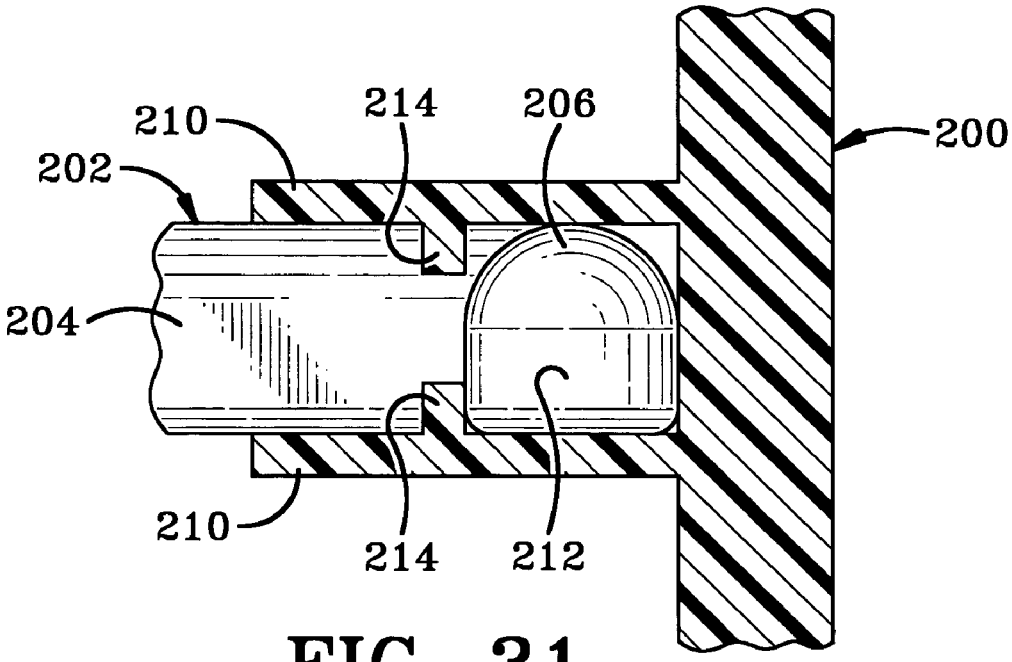

As described above, end assembly 24 may include a body 110 designed to lock to upper rod 28 in an anti-sweeping position. This version of end assembly 24 is depicted in FIGS. 11–15. A lock 44 similar to the lock described above is used to lock the position of body 110 with respect to upper rod 28. Lock 44 works in the same manner described above with respect to base assembly 20. When lock 44 is in locked position and end assembly 24 is in the anti-sweeping position shown in FIGS. 11, 12, and 14, end assembly 24 includes a biased member 112 that surrounds the outer end of lower rod 30 to prevent items 14 from being swept from lower rod 30. In this embodiment, biased element 112 includes a cup 114 that receives the outer end of lower rod 30. A spring 116 is used to bias cup 114 in the anti-sweeping position. A customer may remove item 14 as depicted in FIG. 13 by pressing item 14 against cup 114 to compress spring 116. The user then lowers item 14 away from end assembly 24 and purchases item 14.

The outer end of upper rod 28 may be bent as indicated at numeral 120. Bend 120 functions as a stop for end assembly so that the user does not pull end assembly 24 off of upper rod 28 when moving end assembly 24 to the loading position depicted in FIG. 15. Bend 120 contacts body 110 to stop the movement of end assembly 24 before rod 28 passes entirely out of lock 44. The loading position of end assembly 24 depicted in FIG. 15 allows a clerk loading merchandise 14 onto lower rod 30 to quickly and easily load items 14 without forcing the clerk to load items 14 one at a time.

Bend 120 may also be used to prevent end assembly 24 from rotating with respect to upper rod 28. Portions of body 110 are disposed on either side of bend 120 to limit the rotation of body 110 with respect to rod 28.

An alternative end assembly 24 is shown in FIGS. 16–31 wherein a merchandise identification or merchandise price tag 200 may be mounted to the outer end of end assembly 24 on a mount 202. Mount 202 includes a base bar 204 that extends outwardly from the outer end of end assembly 24. Mount 202 also includes a cross bar 206 that is connected to the outer end of base bar 204 and is disposed substantially perpendicular to base bar 204. Base bar 204 is connected to the center of cross bar 206 such that cross bar 206 extends equal distances from each side of base bar 204.

Base bar 204 and cross bar 206 are configured to interact with a pair of flanges 210 that project from the rear of tag 200 to hold tag 200 in place on end assembly 24. Flanges 210 cooperate to define a channel 212 sized to receive cross bar 206. Flanges 210 may be sized to resiliently clamp against cross bar 206.

Ribs 214 project towards each other from flanges 210 to further close channel 212. The inner ends 216 of ribs 214 are grouped together to define an opening 218. Opening 218 is used to snap tag 200 onto support 202 as shown in FIGS. 23–31. The ends of cross bar 206 may be rounded to help open flanges 210 and ribs 214 when cross bar 206 is being forced through opening 218 into channel 212. Once bar 206 is snapped into channel 212, the user slides tag 200 along bar 206 until base bar 204 snaps in between ends 216 as shown in FIGS. 26–29.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A merchandise display hook used to display items of merchandise from a support structure; the merchandise display hook comprising:

a rod having an inner end and an outer end; the inner end of the rod adapted to be disposed adjacent the support structure when the display hook is connected to the support structure;

a base assembly connected to the rod and slidable between locked and unlocked positions; the locked position of the base assembly adapted to prevent the rod from being removed from the support structure;

the base assembly having a body;

a lock disposed entirely within the body and including a first lock member movable relative to the body between locked and unlocked positions;

the first lock member having an opening;

a portion of the rod being disposed in the opening of the lock; and the first lock member lockably engaging the portion of the rod disposed in the opening when the first lock member is in the locked position to lock the base assembly to the rod such that the rod cannot be removed from the support structure.

2. The hook of claim 1, wherein the opening in the first lock member is non-circular.

3. The hook of claim 1, wherein the opening in the first lock member is oval.

4. The hook of claim 1, wherein the portion of the rod that is disposed in the opening of the first lock member has an exterior diameter; the opening having a pair of semi-circular portions connected by a straight portion; each of the semi-circular portions having a diameter slightly larger than the exterior diameter of the portion of the rod that is disposed in the opening of the first lock member.

5. The hook of claim 1, wherein the first lock member pivots between its locked and unlocked positions.

6. The hook of claim 5, wherein the first lock member pivots with respect to the rod.

7. The hook of claim 1, wherein the lock is magnetically-actuatable.

8. The hook of claim 1, further comprising at least one hook connected to the rod; the at least one hook adapted to connect the rod to the support structure.

9. The hook of claim 1, wherein the rod is free of notches where the first lock member engages the rod.

10. The hook of claim 1 wherein the rod extends longitudinally between the inner end and the outer end and has a longitudinally extending outer surface; and wherein the first lock member in the locked position lockably engages the rod only on the longitudinally extending outer surface thereof.

11. A merchandise display hook used to display items of merchandise from a support structure; the merchandise display hook comprising:

a rod having an inner end and an outer end; the inner end of the rod adapted to be disposed adjacent the support structure when the display hook is connected to the support structure;

a base assembly connected to the rod and slidable between locked and unlocked positions; the locked position of the base assembly adapted to prevent the rod from being removed from the support structure;

the base assembly having a body;

a lock including a first lock member movable between locked and unlocked positions;

the first lock member having an opening;

a portion of the rod being disposed in the opening of the first lock member;

the first lock member engaging the rod when the lock is in the locked position to lock the base assembly to the rod such that the rod cannot be removed from the support structure;

wherein the lock includes a second lock member disposed between the first lock member and the body of the base assembly; the second lock member movable between locked and unlocked positions; the locked position of the second lock member holding the first lock member in its locked position.

12. The hook of claim 11, wherein the second lock member is magnetically-actuatable.

13. The hook of claim 11 wherein the lock is disposed entirely within the body.

14. The hook of claim 11 in combination with support structure; and wherein the base assembly abuts the support structure to prevent the rod from being removed from the support structure.

15. In combination, a support structure and a merchandise display hook used to display items of merchandise from the support structure; the merchandise display hook comprising:

at least a first rod having an inner end and an outer end; the inner end of the at least first rod adapted to be disposed adjacent the support structure when the display hook is connected to the support structure;

a base assembly carried by the rod and slidable between a first position adapted to prevent removal of the first rod from the support structure and a second position adapted to allow removal of the first rod from the support structure; wherein the base assembly abuts the support structure to prevent the rod from being removed from the support structure;

the base assembly including a lock movable between locked and unlocked positions;

the lock having an opening;

a portion of the at least first rod being disposed in the opening of the lock; and the lock engaging the at least first rod when the lock is in the locked position; the locked position of the lock only allowing the base assembly to slide along the rod from the second position toward the first position.

16. The combination of claim 15, wherein the rod has a cross-sectional shape; at least a portion of the opening in the lock matching the cross-sectional shape of the rod.

17. The combination of claim 15 wherein the opening in the lock is oval.

18. The combination of claim 15, wherein the lock pivots between its locked and unlocked positions.

19. The combination of claim 15, wherein the lock includes a first lock member movable between locked and unlocked positions and a second lock member; the second lock member locking the first lock member in its locked position.

20. The combination of claim 19, wherein the second lock member is magnetically-actuatable.

21. The combination of claim 15, wherein the lock is magnetically-actuatable.

22. The combination of claim 15, wherein the rod is free of notches where the lock engages the rod.

23. The hook claim 15 wherein the rod extends longitudinally between the inner end and the outer end and has a longitudinally extending outer surface; wherein the lock has an inwardly-facing surface which defines the opening therein and faces the longitudinally extending outer surface of the rod; wherein the inwardly-facing surface is angled transversely relative to the outer surface of the rod in the locked position; and wherein the inwardly-facing surface is parallel to the outer surface of the rod in the unlocked position.

24. The combination of claim 15 wherein the first position of the base assembly is adjacent the inner end of the first rod and the second position of the base assembly is distal the inner end of the first rod.

25. A merchandise display hook used to display items of merchandise from a support structure; the merchandise display hook comprising:

a rod having an inner end and an outer end: the inner end of the rod adapted to be disposed adjacent the support structure when the display hook is connected to the support structure;

a base assembly connected to the rod and slidable between locked and unlocked positions; the locked position of the base assembly adapted to prevent the rod from being removed from the support structure;

the base assembly having a body;

a lock including a first lock member movable relative to the body between locked and unlocked positions;

the first lock member having an opening;

a portion of the rod being disposed in the opening of the lock;

the first lock member lockably engaging the portion of the rod disposed in the opening when the first lock member is in the locked position to lock the base assembly to the rod such that the rod cannot be removed from the support structure; and wherein the rod extends longitudinally between the inner end and the outer end and has a longitudinally extending outer surface; wherein the first lock member has an inwardly-facing surface which defines the opening therein and faces the longitudinally extending outer surface of the rod; wherein the inwardly-facing surface is angled transversely relative to the outer surface of the rod in the locked position; and wherein the inwardly-facing surface is parallel to the outer surface of the rod in the unlocked position.

26. In combination, a support structure and a merchandise display hook used to display items of merchandise from the support structure; the merchandise display hook comprising:

a rod having an inner end and an outer end; the inner end of the rod adapted to be disposed adjacent the support structure when the display hook is connected to the support structure;

a base assembly connected to the rod and slidable between locked and unlocked positions; the locked position of the base assembly adapted to prevent the rod from being removed from the support structure;

the base assembly having a body;

a lock including a first lock member movable relative to the body between locked and unlocked positions;

the first lock member having an opening;

a portion of the rod being disposed in the opening of the lock;

the first lock member lockably engaging the portion of the rod disposed in the opening when the first lock member is in the locked position to lock the base assembly to the rod such that the rod cannot be removed from the support structure; and wherein the base assembly abuts the support structure to prevent the rod from being removed from the support structure.

27. The combination of claim 26 wherein the lock is disposed entirely within the body.

28. In combination, a support structure and a merchandise display hook used to display items of merchandise from the support structure; the merchandise display hook comprising:

a rod having an inner end and an outer end; the inner end of the rod adapted to be disposed adjacent the support structure when the display hook is connected to the support structure;

a base assembly connected to the rod and slidable between locked and unlocked positions; the locked position of the base assembly adapted to prevent the rod from being removed from the support structure;

the base assembly having a body;

a lock including a first lock member movable relative to the body between locked and unlocked positions;

the first lock member having an opening;

a portion of the rod being disposed in the opening of the lock;

the first lock member lockably engaging the portion of the rod disposed in the opening when the first lock member is in the locked position to lock the base assembly to the rod such that the rod cannot be removed from the support structure; and wherein when the first lock member is in the unlocked position the rod is pivotable between a mounted position in which the rod is mounted on the support structure and an unmounted position in which the rod is removed from the support structure; and wherein when the first lock member is in the locked position the body prevents the rod from pivoting from the mounted to the unmounted position.

29. The combination of claim 28 wherein the body abuts the support structure to prevent the rod from pivoting from the mounted to the unmounted position.

30. A merchandise display hook used to display items of merchandise from a support structure; the merchandise display hook comprising:

a rod having an inner end and an outer end; the inner end of the rod adapted to be disposed adjacent the support structure when the display hook is connected to the support structure;

a base assembly including a body defining a through opening and a first lock member defining a through opening aligned with the through opening of the body; wherein the body defines an interior chamber in which the first lock member is entirely disposed;

wherein the through opening of the body slidably receives the rod whereby the body is slidable along the rod between a first position adapted to prevent the rod from being removed from the support structure and a second position adapted to allow the rod to be removed from the support structure;

wherein the rod is received within the through opening of the first lock member;

wherein the first lock member is movable relative to the body between a locked position in which the first lock member lockably engages the rod to lock the body to the rod in the first position of the body and an unlocked position in which the body is slidable from the first position to the second position.

31. In combination, a support structure and a merchandise display hook used to display items of merchandise from the support structure; the merchandise display hook comprising:

a rod having an inner end and an outer end; the inner end of the rod adapted to be disposed adjacent the support structure when the display hook is connected to the support structure;

a base assembly including a body defining a through opening and a first lock member defining a through opening aligned with the through opening of the body;

wherein the through opening of the body slidably receives the rod whereby the body is slidable along the rod between a first position adapted to prevent the rod from being removed from the support structure and a second position adapted to allow the rod to be removed from the support structure;

wherein the rod is received within the through opening of the first lock member;

wherein the first lock member is movable relative to the body between a locked position in which the first lock member lockably engages the rod to lock the body to the rod in the first position of the body and an unlocked position in which the body is slidable from the first position to the second position; and wherein the base assembly abuts the support structure to prevent the rod from being removed from the support structure.

32. A merchandise display hook used to display items of merchandise from a support structure; the merchandise display hook comprising:

a rod having an inner end and an outer end; the inner end of the rod adapted to be disposed adjacent the support structure when the display hook is connected to the support structure;

a base assembly including a body defining a through opening and a first lock member defining a through opening aligned with the through opening of the body;

wherein the through opening of the body slidably receives the rod whereby the body is slidable along the rod between a first position adapted to prevent the rod from being removed from the support structure and a second position adapted to allow the rod to be removed from the support structure;

wherein the rod is received within the through opening of the first lock member;

wherein the first lock member is movable relative to the body between a locked position in which the first lock member lockably engages the rod to lock the body to the rod in the first position of the body and an unlocked position in which the body is slidable from the first position to the second position; and a hook which is rigidly connected to the rod; wherein the rod and hook are pivotable as a unit between a mounted position in which the hook is adapted to extend through an opening in the support structure to mount the rod to the support structure and an unmounted position in which the hook is removed from the opening in the support structure; and wherein the body in the first position prevents the unit from pivoting from the mounted to the unmounted position.

33. A merchandise display hook used to display items of merchandise from a support structure; the merchandise display hook comprising:

a rod having an inner end and an outer end; the inner end of the rod adapted to be disposed adjacent the support structure when the display hook is connected to the support structure;

a base assembly including a body and a first lock member carried by the body;

wherein the body is movable along the rod between a first position adapted to prevent the rod from being removed from the support structure and a second position adapted to allow the rod to be removed from the support structure;

wherein the first lock member includes a plate defining a through opening in which a portion of the rod is disposed;

wherein the first lock member is movable relative to the body between locked and unlocked positions; wherein in the locked position the plate engages the rod to lock the body in the first position to the rod; wherein in the unlocked position the plate is slidable along the rod to allow the body to move to the second position;

wherein the plate is transverse to the rod in each of the locked and unlocked positions.

34. The hook of claim 33 wherein the body defines an interior chamber in which the first lock member is entirely disposed.

35. The hook of claim 33 wherein the plate is perpendicular to the rod in the unlocked position.

36. The hook of claim 33 wherein the first position of the body of the base assembly is at the inner end of the rod.

37. The hook of claim 33 wherein the first lock member includes a leg which is connected to and extends transversely from the plate; and further including a second lock member which abuts the leg to bias the first lock member to the locked position.

38. The hook of claim 33 wherein the first lock member includes a leg which is connected to and extends transversely from the plate; wherein the plate and the leg are connected at an intersection therebetween; and wherein the first lock member includes a pair of spaced pivot arms extending outwardly from adjacent the intersection and engaging the body to provide a pivot about which the first lock member pivots between the locked and unlocked positions.

39. The hook of claim 33 wherein the rod extends longitudinally between the inner end and the outer end and has a longitudinally extending outer surface; and wherein the first lock member in the locked position lockably engages the rod only on the longitudinally extending outer surface thereof.

40. The hook of claim 33 in combination with the support structure; wherein the base assembly abuts the support structure to prevent the rod from being removed from the support structure.

41. The hook of claim 33 wherein the lock is disposed entirely within the body.

* * * * *